US011614096B2

(12) United States Patent
Tanishima et al.

(10) Patent No.: US 11,614,096 B2
(45) Date of Patent: Mar. 28, 2023

(54) AIR-SENDING DEVICE, AND AIR-CONDITIONING APPARATUS INCLUDING THE AIR-SENDING DEVICE

(71) Applicant: Mitsubishi Electric Corporation, Chiyoda-ku (JP)

(72) Inventors: Makoto Tanishima, Chiyoda-ku (JP); Takashi Matsumoto, Chiyoda-ku (JP); Yoji Onaka, Chiyoda-ku (JP); Takamasa Uemura, Chiyoda-ku (JP); Hiroki Fukuoka, Chiyoda-ku (JP); Rihito Adachi, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 338 days.

(21) Appl. No.: 16/766,947

(22) PCT Filed: Nov. 14, 2018

(86) PCT No.: PCT/JP2018/042094
§ 371 (c)(1),
(2) Date: May 26, 2020

(87) PCT Pub. No.: WO2019/116810
PCT Pub. Date: Jun. 20, 2019

(65) Prior Publication Data

US 2020/0309151 A1 Oct. 1, 2020

(30) Foreign Application Priority Data

Dec. 13, 2017 (JP) ..... JP2017-238778

(51) Int. Cl.
*F04D 29/42* (2006.01)
*F24F 13/22* (2006.01)
(Continued)

(52) U.S. Cl.
CPC ..... *F04D 29/4226* (2013.01); *F24F 1/0022* (2013.01); *F24F 13/222* (2013.01); *F24F 13/24* (2013.01)

(58) Field of Classification Search
CPC ..... F24F 13/24; F24F 13/222; F24F 1/0018; F24F 1/0022; F24F 2013/245;
(Continued)

(56) References Cited

U.S. PATENT DOCUMENTS

2010/0221107 A1 9/2010 Anschel et al.
2015/0071775 A1* 3/2015 Kashihara ..... F24F 1/0071 415/206
2017/0089605 A1* 3/2017 Kim ..... F24F 11/77

FOREIGN PATENT DOCUMENTS

CN 201925993 U 8/2011
DE 885 200 8/1953
(Continued)

OTHER PUBLICATIONS

Office Action dated Dec. 1, 2020, in corresponding Japanese patent Application No. 2019-510374, 14 pages.
(Continued)

*Primary Examiner* — Frantz F Jules
*Assistant Examiner* — Martha Tadesse
(74) *Attorney, Agent, or Firm* — Xsensus LLP

(57) ABSTRACT

An air-sending device includes a housing including an inlet air passage communicating with an air inlet and an outlet air passage communicating with an air outlet, a first partition plate partitioning an interior of the housing into the inlet air passage and the outlet air passage, a bell mouth disposed around an opening defined in the first partition plate, and an impeller disposed over the first partition plate across the bell mouth and having a rotation axis that extends in a direction that intersects the first partition plate. The impeller suctions
(Continued)

air into the inlet air passage from the air inlet, and blows out air from the air outlet through the outlet air passage. The inlet air passage guides air from the air inlet to the opening along the first partition plate, and has an air-passage wall.

21 Claims, 15 Drawing Sheets

(51) Int. Cl.
*F24F 1/0022* (2019.01)
*F24F 13/24* (2006.01)

(58) Field of Classification Search
CPC .. F24F 2013/205; F04D 25/08; F04D 29/665; F04D 29/663; F04D 29/4213; F04D 29/4226; F05D 2250/191; F05D 2250/75
See application file for complete search history.

(56) References Cited

FOREIGN PATENT DOCUMENTS

| | | | | |
|---|---|---|---|---|
| DE | 32 26 217 | A1 | | 3/1983 |
| DE | 3226217 | A1 | * | 3/1983 |
| JP | 61-119048 | U | | 7/1986 |
| JP | 3047001 | U | | 3/1998 |
| JP | H10-300130 | A | | 11/1998 |
| JP | 11-82386 | A | | 3/1999 |
| JP | 11082386 | A | * | 3/1999 |
| JP | 2000-356362 | A | | 12/2000 |
| JP | 2000356362 | A | * | 12/2000 |
| JP | 2007-321738 | A | | 12/2007 |
| JP | 2007321738 | A | * | 12/2007 |
| JP | 2010-127165 | A | | 6/2010 |
| JP | 2015-175557 | A | | 10/2015 |
| JP | 2016-3594 | A | | 1/2016 |
| WO | WO 2016/158252 | A1 | | 10/2012 |

OTHER PUBLICATIONS

International Search Report dated Dec. 11, 2018 in PCT/JP2018/042094 filed Nov. 14, 2018, 2 pages.
Japanese Office Action dated Apr. 22, 2019 in Japanese Patent Application No. 2019-510374 (with English translation), 18 pages.
Japanese Office Action dated Aug. 21, 2019 in Japanese Patent Application No. 2019-510374 (with English translation), 23 pages.
Office Action dated Dec. 28, 2020 issued in corresponding Chinese Patent Application No. 201880074975.5.
Extended European Search Report dated Jan. 11, 2021 issued in corresponding European Patent Application No. 18888676.6.

* cited by examiner

AIR-SENDING DEVICE, AND AIR-CONDITIONING APPARATUS INCLUDING THE AIR-SENDING DEVICE

TECHNICAL FIELD

The present disclosure relates to an air-sending device, and an air-conditioning apparatus including the air-sending device.

BACKGROUND ART

For example, Patent Literature 1 discloses an air-sending device described below. The air-sending device includes a centrifugal fan, and a sleeve-shaped air suction passage that extends in a direction perpendicular to the rotation axis of the impeller of the centrifugal fan. With the configuration according to Patent Literature 1, a flow rectifier and a flow dividing wall are disposed in the air suction passage to moderate and stabilize the inlet swirl flow, and smooth and stable suction of air through the entire periphery of the bell mouth is thus enabled. As a result, the configuration according to Patent Literature 1 improves airflow rate-pressure characteristics, and reduced noise and reduced shaft power are thus achieved.

CITATION LIST

Patent Literature

Patent Literature 1: Japanese Unexamined Patent Application Publication No. 2010-127165

SUMMARY OF INVENTION

Technical Problem

With the air-sending device described in Patent Literature 1, the presence of the flow rectifier and the flow dividing wall in the air suction passage makes it possible to control the current of air in the air suction passage. However, the locations and shapes of the flow rectifier and the flow dividing wall exert a large influence on the current of air, and robustness is thus reduced. In other words, the flow rectifier and the flow dividing wall have a large influence on the current of air, and each have a limited range of design optimization for the flow rectifier and the flow dividing wall to obtain a desired effect.

Further, the air-sending device described in Patent Literature 1 has a large number of components, and the flow rectifier and the flow dividing wall have complicated shapes. This configuration thus can reduce the ease of construction and increase cost.

The present disclosure has been made in view of the above-mentioned problems, and accordingly it is an object of the disclosure to provide an air-sending device capable of achieving both reduced fan input and reduced noise by use of a simple structure, and an air-conditioning apparatus including the air-sending device.

Solution to Problem

An air-sending device according to an embodiment of the present disclosure includes a housing including an inlet air passage and an outlet air passage, the inlet air passage communicating with an air inlet, the outlet air passage communicating with an air outlet, a first partition plate partitioning an interior of the housing into the inlet air passage and the outlet air passage, a bell mouth disposed around an opening defined in the first partition plate, and an impeller disposed over the first partition plate with the bell mouth interposed between the impeller and the first partition plate, the impeller having a rotation axis that extends in a direction that intersects the first partition plate. The impeller is configured to suction air into the inlet air passage from the air inlet, and blow out air from the air outlet through the outlet air passage. The inlet air passage guides air from the air inlet to the opening along the first partition plate, and has an air-passage wall, the air-passage wall being located at a position in the inlet air passage that is past a center of the opening along the first partition plate from the air inlet. A distance from the rotation axis of the impeller to the air-passage wall is less than a distance from the rotation axis of the impeller to an end portion of the bell mouth that is close to the air inlet to prevent air from entering the impeller from an area located farther from the air inlet than is the air-passage wall.

Advantageous Effects of Invention

With the air-sending device according to an embodiment of the present disclosure, an air-passage wall is provided to define a portion of an inlet air passage. This configuration makes it possible to achieve both reduced fan input and reduced noise by use of a simple structure.

DESCRIPTION OF EMBODIMENTS

Figure 1:
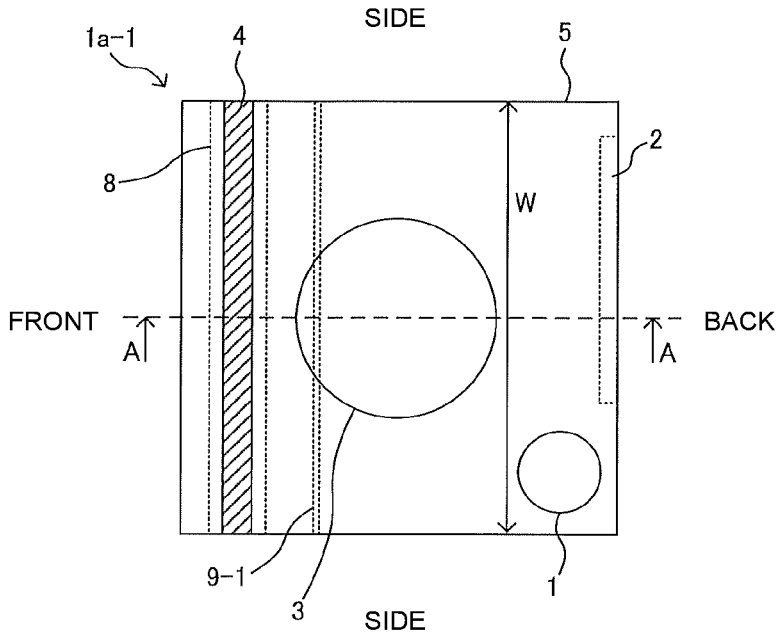
FIG. 1 is a schematic top view of a heat source device of an air-conditioning apparatus according to Embodiment 1 of the present disclosure.

Embodiments of the present disclosure will be described below with reference to the drawings. In the following drawings including FIG. 1, the relative sizes of various components may not be drawn to scale. Elements designated by the same reference signs in the following drawings including FIG. 1 represent the same or corresponding elements throughout the specification. Further, the specific forms or configurations of components represented throughout the specification are intended to be illustrative only and not limiting.

Embodiment 1

Figure 2:
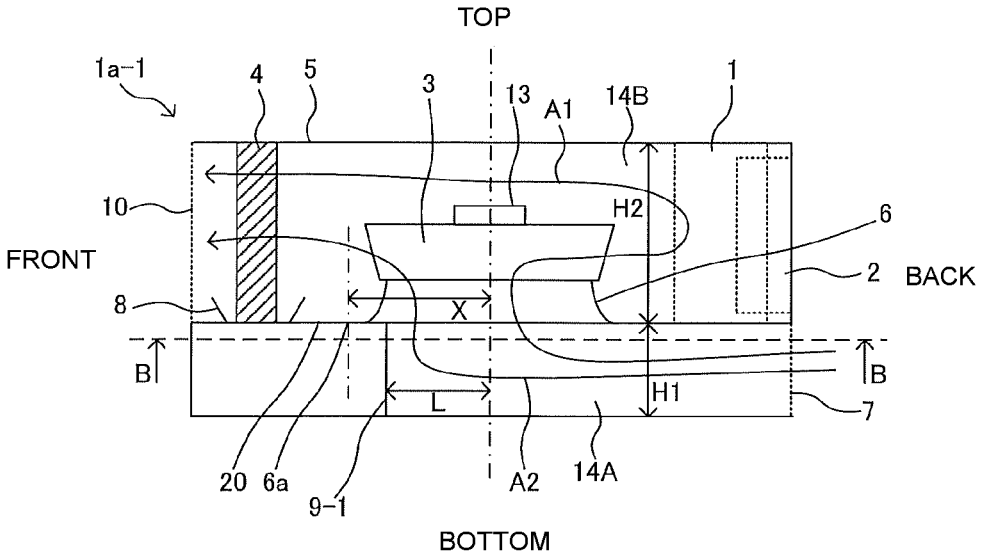
FIG. 2 is an exemplary schematic cross-sectional view taken along A-A in FIG. 1.

FIG. 1 is a schematic top view of a heat source device 1*a*-1 of an air-conditioning apparatus according to Embodiment 1 of the present disclosure. FIG. 2 is an exemplary schematic cross-sectional view taken along A-A in FIG. 1. The heat source device 1*a*-1 will be described below with reference to FIGS. 1 and 2. FIG. 1 schematically depicts the interior of the heat source device 1*a*-1. In FIG. 2, an arrow A1 and an arrow A2 each represent the flow of air. Further, FIGS. 1 and 2 depict an exemplary state in which the right in FIGS. 1 and 2 corresponds to the back of the heat source device 1*a*-1, and the left in FIGS. 1 and 2 corresponds to the front of the heat source device 1*a*-1.

An air-conditioning apparatus according to Embodiment 1 is used to heat or cool, for example, an indoor space in a house, an office building, an apartment, or other structures, that is, an air-conditioned space. The air-conditioning apparatus according to Embodiment 1 includes a load-side device, and the heat source device 1*a*-1. Further, the air-conditioning apparatus includes a refrigerant circuit in which elements or devices incorporated in the load-side device and in the heat source device 1*a*-1 are connected by pipes. Refrigerant is circulated in the refrigerant circuit to execute heating or cooling of the air-conditioned space. The heat source device 1*a*-1 is used as a heat source-side unit or an outdoor unit. The load-side device is used as a load-side unit, a use-side unit, or an indoor unit. The air-conditioning apparatus according to Embodiment 1 will be described later with reference to FIG. 12.

As illustrated in FIGS. 1 and 2, the heat source device 1*a*-1 includes at least one heat exchanger 4, a compressor 1, a control box 2, an impeller 3, a bell mouth 6, a fan motor 13, and a drain pan 8. The heat exchanger 4, the compressor 1, the control box 2, the impeller 3, the bell mouth 6, the fan motor 13, and the drain pan 8 are installed in a housing 5 that defines the enclosure of the heat source device 1*a*-1.

The housing 5 has an air inlet 7 and an air outlet 10. The air inlet 7 and the air outlet 10 are opened to communicate between the outside and inside of the housing 5. The air inlet 7 is open, for example, on the back face of the housing 5. The air outlet 10 is open, for example, on the front face of the housing 5. In other words, the heat source device 1*a*-1 is not designed to admit or blow out air from the bottom or top face of the housing 5 but designed to admit air from one side face of the housing 5 and blow out air from another side face of the housing 5. The side face of the housing 5 is made detachable, and thus the opening provided when the side face of the housing 5 is detached defines the air inlet 7.

The heat exchanger 4 is disposed between an area downstream of the impeller 3, and the air outlet 10.

The impeller 3 has a rotation axis. The impeller 3 rotates about the rotation axis to thereby transport air. The impeller 3 is rotationally driven by the fan motor 13.

The bell mouth 6 is installed to the suction portion of the impeller 3, that is, around an opening defined in a first partition plate 20. The bell mouth 6 guides the air flowing in an inlet air passage 14A to the impeller 3. The bell mouth 6 has an opening portion that gradually decreases in width from an inlet of the opening portion that is close to the inlet air passage 14A toward the impeller 3. In FIG. 2, an end portion of the inlet radius of the bell mouth 6 located farthest from the air inlet 7 is depicted as an end portion 6*a* of the bell mouth 6.

The drain pan 8 is disposed below the heat exchanger 4.

The interior of the housing 5 is partitioned by the first partition plate 20 into the inlet air passage 14A and an outlet air passage 14B. More specifically, the first partition plate 20 that partitions the housing 5 into upper and lower areas is disposed in the housing 5 to define portions of the inlet air passage 14A and the outlet air passage 14B. In other words, the first partition plate 20 that partitions the housing 5 into upper and lower areas is disposed to provide the housing 5 with a two-level structure. The first partition plate 20 has an opening that communicates between the inlet air passage 14A and the impeller 3. The bell mouth 6 is installed at the opening. In this regard, partitioning the housing 5 into upper and lower areas means partitioning the housing 5 into upper and lower areas in the state illustrated in FIG. 2.

The inlet air passage 14A is defined in a lower portion of the housing 5 by the wall surface of the housing 5 and an air-passage partition plate 9-1, which is placed facing the air inlet 7. The inlet air passage 14A communicates with the air inlet 7 to guide air admitted through the air inlet 7 to the bell mouth 6.

The outlet air passage 14B is defined in an upper portion of the housing 5. The outlet air passage 14B communicates with the air outlet 10 to guide air blown out from the impeller 3 to the air outlet 10.

Further, the air-passage partition plate 9-1 is detachably disposed in the inlet air passage 14A and partitions the inlet air passage 14A into left and right areas. In other words, the inlet air passage 14A is blocked at a point by the air-passage partition plate 9-1. Consequently, air admitted through the air inlet 7 and flowing in the inlet air passage 14A collides with the air-passage partition plate 9-1, and thus changes the direction of the air toward the bell mouth 6. In the absence of the air-passage partition plate 9-1, an air current would flow in the space between the end portion 6*a* of the bell mouth and the air-passage partition plate 9-1. However, because of the presence of the air-passage partition plate 9-1, such an air current is blocked and suctioned into the impeller 3. This configuration helps prevent entry of air into the impeller 3 from an area located farther from the air inlet 7 than is the air-passage partition plate 9-1.

In this regard, partitioning the inlet air passage 14A into left and right areas means partitioning the inlet air passage 14A into left and right areas in the state illustrated in FIG. 2. Further, preventing entry of air means not only entry of air at a reduced flow rate but also completely no entry of air.

The air-passage partition plate 9-1 corresponds to "air-passage wall".

The air-passage partition plate 9-1 is equal in width to the inlet air passage 14A, and is equal in height to the inlet air passage 14A. As illustrated in FIG. 2, the air-passage partition plate 9-1 is disposed vertically. Being disposed vertically means being disposed in such a manner that a wall surface of the air-passage partition plate 9-1 that faces the inlet air passage 14A extends perpendicularly to the bottom of the inlet air passage 14A.

As the impeller 3 is driven, as represented by the arrow A1 and the arrow A2 in FIG. 2, air admitted through the air inlet 7 is suctioned in from below the impeller 3 via the bell mouth 6, and blown out in the circumferential direction of the impeller 3. The air is then heated or cooled in the heat exchanger 4, and blown out through the air outlet 10. As described above, the air inlet 7 is provided, for example, on the back face of the housing 5. The air outlet 10 is provided, for example, on the front face of the housing 5.

As a result, the orientation of the air inlet 7 can be changed simply by attachment or detachment of a portion of the side face of the housing 5 and the air-passage partition plate 9-1 that define a portion of the inlet air passage 14A. In other words, with the heat source device 1*a*-1, the air inlet 7 can be oriented in any one of the following directions: toward the front face, toward the side face located at the top in FIG. 1, toward the back face, and toward the side face located at the bottom in FIG. 1. Accordingly, with the heat source device 1*a*-1, the orientation of the air inlet 7 can be changed depending on where the heat source device 1*a*-1 is installed. This configuration provides increased freedom on where to install the heat source device 1*a*-1.

A portion of the inlet air passage 14A includes, for example, a sheet metal defining the bottom of the inlet air passage 14A, sheet metals defining sides of the inlet air passage 14A, and a fastening piece such as a screw for securing these sheet metals in place.

The inlet air passage 14A has a width W greater than the outside diameter of the impeller 3. The inlet air passage 14A has a height H1 less than a height H2 of the outlet air passage 14B. The width W of the inlet air passage 14A means the distance in the vertical direction in FIG. 1. The height of the inlet air passage 14A means the distance in the vertical direction in FIG. 2.

The distance from the rotation axis of the impeller 3 to the end portion 6*a* of the bell mouth 6 is defined as X. The air-passage partition plate 9-1 is disposed at such a position that the air-passage partition plate 9-1 is located closer to the air inlet 7 than is the end portion 6*a* of the bell mouth 6, and that the distance L from the rotation axis of the impeller 3 to the air-passage partition plate 9-1 is less than the distance X. The air-passage partition plate 9-1 is disposed vertically, and is thus parallel to the axial direction of the impeller 3. The rotation axis of the impeller 3 extends in a direction that intersects the first partition plate 20. Although the rotation axis of the impeller 3 preferably extends in a direction perpendicular to the first partition plate 20, the direction of the rotation axis may not necessarily be strictly perpendicular but may slightly deviate from the perpendicular direction.

The air-passage partition plate 9-1 will be described below in detail.

Figure 3:
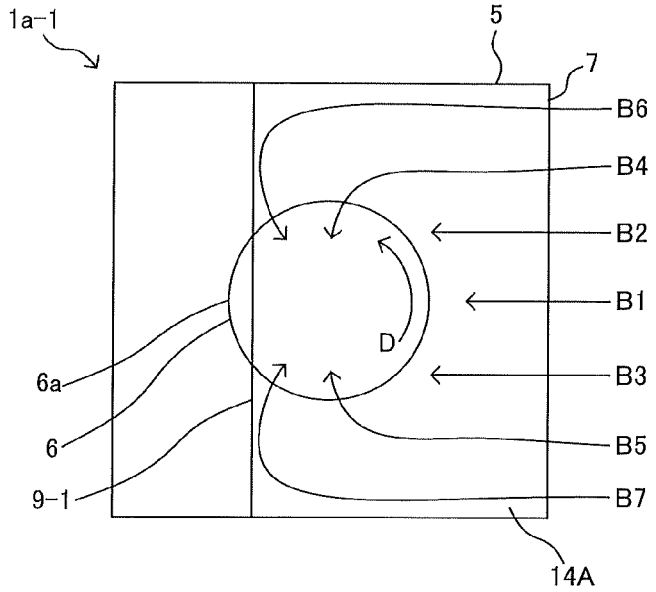
FIG. 3 schematically illustrates how air flows in an inlet air passage.
Figure 4:
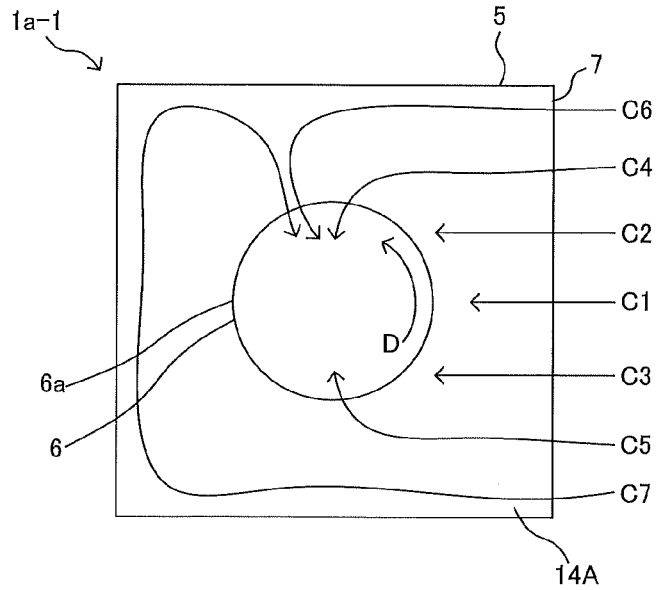
FIG. 4 schematically illustrates how air flows in an inlet air passage in a comparative example with no air-passage partition plate provided.

FIG. 3 schematically illustrates how air flows in the inlet air passage 14A. FIG. 4 schematically illustrates how air flows in the inlet air passage 14A in a comparative example with no air-passage partition plate 9-1 provided. FIGS. 3 and 4 each schematically depict an exemplary cross-section taken along B-B in FIG. 2. In FIG. 3, arrows B1 to B7 each represent the flow of air. In FIG. 4, arrows C1 to C7 each represent the flow of air. Further, in FIGS. 3 and 4, an arrow D represents the direction of rotation of the impeller 3.

As illustrated in FIG. 3, air entering through the central portion of the air inlet 7 as represented by the arrows B1 to B3 travels straight forward in the inlet air passage 14A along the inner surface of the bell mouth 6. Air entering through the area between the central portion of the air inlet 7 and each side of the air inlet 7 as represented by the arrows B4 and B5 first travels straight forward in the inlet air passage 14A, and is then directed along the inner surface of the bell mouth 6 before the air collides with the air-passage partition plate 9-1. Meanwhile, air entering through each side of the air inlet 7 as represented by the arrows B6 and B7 first travels straight forward in the inlet air passage 14A, and then collides with the air-passage partition plate 9-1. After the air collides with the air-passage partition plate 9-1, the air changes the direction of the air toward the central area because of the negative pressure of the impeller 3, and is directed along the inner surface of the bell mouth 6 through a portion of the bell mouth 6 opposite to the air inlet 7. Thus, no air flows in the space in an upstream portion of the bell mouth 6 located between an end portion of the bell mouth 6 opposite to the air inlet 7 and the air-passage partition plate 9-1.

In other words, the presence of the air-passage partition plate 9-1 ensures that air can be guided from the air inlet to a downstream portion of the bell mouth 6 through a short path. As a result, air uniformly enters the bell mouth 6 through the entire periphery of the bell mouth 6, and maximum performance of the impeller 3 thus can be extracted.

As illustrated in FIG. 4, air entering through the central portion of the air inlet 7 as represented by the arrows C1 to C3 travels straight forward in the inlet air passage 14A along the inner surface of the bell mouth 6. Air entering through the area between the central portion of the air inlet 7 and each side of the air inlet 7 as represented by the arrows C4 and C5 first travels straight forward in the inlet air passage 14A, and is then directed along the inner surface of the bell mouth 6. Meanwhile, air entering through one side of the air inlet 7 as represented by the arrow C7 first travels straight forward in the inlet air passage 14A, and then collides with the side face at the back of the inlet air passage 14A. The air then changes the direction of the air toward the central area. After the air travels straight forward again, the air collides with a side face of the inlet air passage 14A. The air then further changes the direction of the air toward the air inlet 7, and collides with the flow of air represented by the arrow C6 that has entered from the other side of the air inlet 7. The resulting flow of air flows along the inner surface of the bell mouth 6 from the vicinity of the 11 o'clock position of the bell mouth 6.

In other words, less air flows along the inner surface of the bell mouth 6 through areas between the 6 o'clock and 11 o'clock positions of the bell mouth 6, making it impossible to suction in air uniformly through the entire periphery of the bell mouth 6. When air is unable to enter the bell mouth 6 uniformly through the entire periphery of the bell mouth 6, differences arise in air velocity and in pressure in the circumferential direction of the impeller 3, and performance of the impeller 3 is thus degraded. Further, pressure fluctuations can also lead to increased noise.

Figure 5:
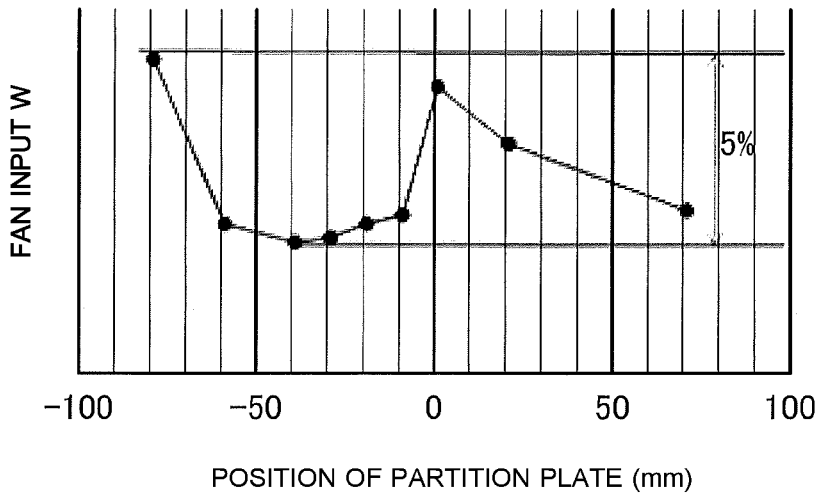
FIG. 5 is a graph illustrating the relationship between the position of an air-passage partition plate, and power input to an impeller.

FIG. 5 is a graph illustrating the relationship between the position of the air-passage partition plate 9-1, and power input to the impeller 3. With reference to FIG. 5, the relationship between the position of the air-passage partition plate 9-1, and power input to the impeller 3 will be described below. In FIG. 5, the vertical axis represents power (W) input to the fan motor 13, which drives the impeller 3, and the horizontal axis represents the position (mm) of the air-passage partition plate 9-1. In the following description, the power input to the fan motor 13, which drives the impeller 3, will be referred to simply as fan input.

The reference position of the air-passage partition plate 9-1 is defined as the position at which the air-passage partition plate 9-1 is placed at the end portion 6*a* of the bell mouth 6. This position is represented as "0 mm" in FIG. 5. With reference to this position, the air-passage partition plate 9-1 is moved horizontally within a range of the inlet air passage 14A. In FIG. 5, "−" positions represent positions when the air-passage partition plate 9-1 is moved toward the air inlet 7, and "+" positions represent positions when the air-passage partition plate 9-1 is moved away from the air inlet 7.

Fan input represents power input to the fan motor 13, which drives the impeller 3, for each position of the air-passage partition plate 9-1. FIG. 5 depicts an exemplary case in which the difference between the maximum and minimum values of fan input is 5%.

The "+70 mm" position of the air-passage partition plate 9-1 represents, for example, the position at which the air-passage partition plate 9-1 is located in the same plane as is the air outlet 10. The fan input at this time is less than the value of the fan input at the reference position of the air-passage partition plate 9-1. As the air-passage partition plate 9-1 is moved to positions such as "+20 mm" and "0 mm" toward the air inlet 7, the fan input increases stepwise from the value of the fan input at the "+70 mm" position of the air-passage partition plate 9-1.

As the air-passage partition plate 9-1 is further moved toward the air inlet 7, at positions from "−10 mm" to "−60 mm", the fan input becomes less than the value of the fan input at the reference position of the air-passage partition plate 9-1. Then, when the air-passage partition plate 9-1 is at the "−70 mm" position, the fan input begins to increase again. When the air-passage partition plate 9-1 is at the "−80 mm" position, the fan input is greater than the value of the fan input at the reference position of the air-passage partition plate 9-1.

The above findings indicate that from the viewpoint of reducing fan input, it is effective to place the air-passage partition plate 9-1 at the "+70 mm" position and at the "−10 mm" to "−60 mm" positions. It is to be noted, however, that at the "+70 mm" position, the air-passage partition plate 9-1 is located in the same plane as is the air outlet 10 or in proximity to the air outlet 10. At this position, the air-passage partition plate 9-1 is located closer to the air outlet 10 than is the end portion 6*a* of the bell mouth 6, and thus the condition about the distance L mentioned above is not satisfied.

Figure 6:
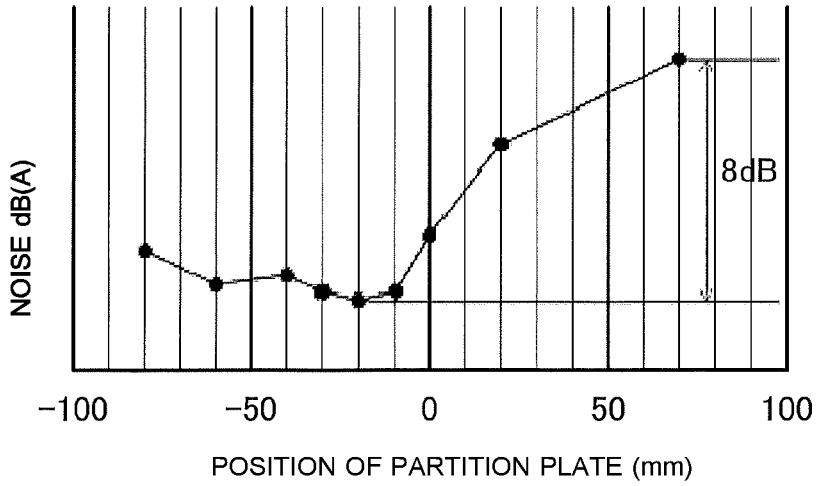
FIG. 6 is a graph illustrating the relationship between the position of an air-passage partition plate, and noise.

FIG. 6 is a graph illustrating the relationship between the position of the air-passage partition plate 9-1, and noise. With reference to FIG. 6, the relationship between the position of the air-passage partition plate 9-1, and noise will be described below. In FIG. 6, the vertical axis represents noise (dB(A)), and the horizontal axis represents the position (mm) of the air-passage partition plate 9-1.

As for the position of the air-passage partition plate 9-1, as in FIG. 5, the position of the air-passage partition plate 9-1 when the air-passage partition plate 9-1 is placed at the end portion 6*a* of the bell mouth 6 is defined as a reference position, and the air-passage partition plate 9-1 is moved horizontally within the range of the inlet air passage 14A.

Noise represents the noise measured at each position of the air-passage partition plate 9-1. A noise meter that measures noise is located on the extension of the rotation axis of the impeller 3, for example, at 1 m from the bottom of the inlet air passage 14A. FIG. 6 depicts an exemplary case in which the difference between the maximum and minimum values of noise is 8 dB.

The "+70 mm" position of the air-passage partition plate 9-1 represents, for example, the position at which the air-passage partition plate 9-1 is located in the same plane as is the air outlet 10. The noise at this time is greater than the value of the noise at the reference position of the air-passage partition plate 9-1. As the air-passage partition plate 9-1 is moved to positions such as "+20 mm" and "0 mm" toward the air inlet 7, the noise decreases stepwise from the value of the noise at the "+70 mm" position of the air-passage partition plate 9-1. As the air-passage partition plate 9-1 is further moved toward the air inlet 7, the noise becomes minimum at the "−20 mm" position. As the air-passage partition plate 9-1 is further moved toward the air inlet 7, the noise begins to increase slightly again.

The above findings indicate that from the viewpoint of noise, it is effective to place the air-passage partition plate 9-1 at the "−10 mm" to "−60 mm" positions.

Therefore, to achieve both reduced fan input and reduced noise, it is preferable to place the air-passage partition plate 9-1 within the range of positions from −10 mm to −60 mm. These positions correspond to 75% to 95% of the inlet radius of the bell mouth 6.

As described above, with the heat source device 1*a*-1, fan input and noise can be reduced by use of a simple structure, that is, the air-passage partition plate 9-1. The heat source device 1*a*-1 configured as described above thus eliminates the need to employ a complicated structure. This configuration ensures improved robustness, and makes it possible to reduce a decrease in the ease of construction and an increase in cost.

<Modification 1>

Figure 7:
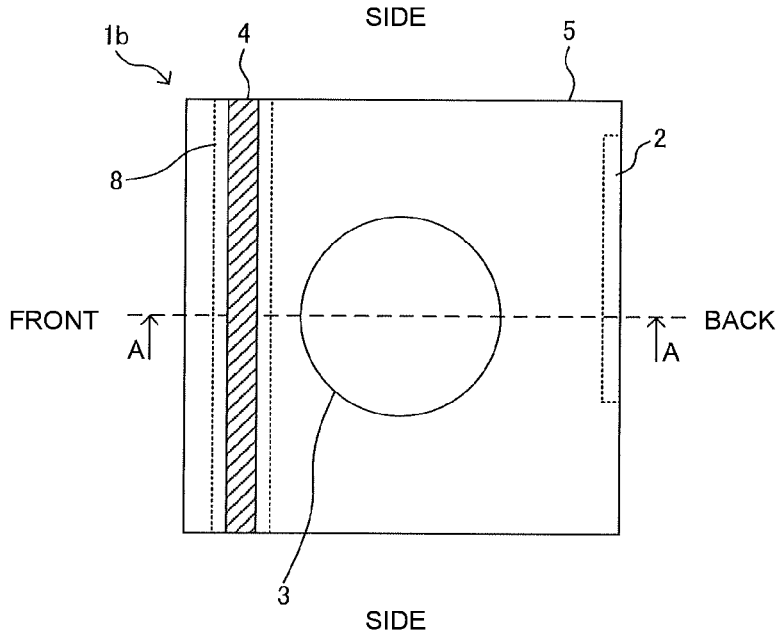
FIG. 7 is a schematic top view of a load-side device of the air-conditioning apparatus according to Embodiment 1 of the present disclosure.

FIG. 7 is a schematic top view of a load-side device 1*b* of the air-conditioning apparatus according to Embodiment 1 of the present disclosure. Modification 1 included in the air-conditioning apparatus will be described below with reference to FIG. 7.

Although the heat source device 1*a*-1 has been described above as an example with reference to FIGS. 1 to 6, the same description as above is applicable to the load-side device 1*b* as illustrated in FIG. 7. The load-side device 1*b* illustrated in FIG. 7 corresponds to a device obtained by removing the compressor 1 from the heat source device 1*a*-1 illustrated in FIGS. 1 to 6. By providing the air-passage partition plate 9-1 to the load-side device 1*b* with such a configuration, the same effect as described above with reference to the heat source device 1*a*-1 can be obtained for the load-side device 1*b* as well.

<Modification 2>

Figure 8:
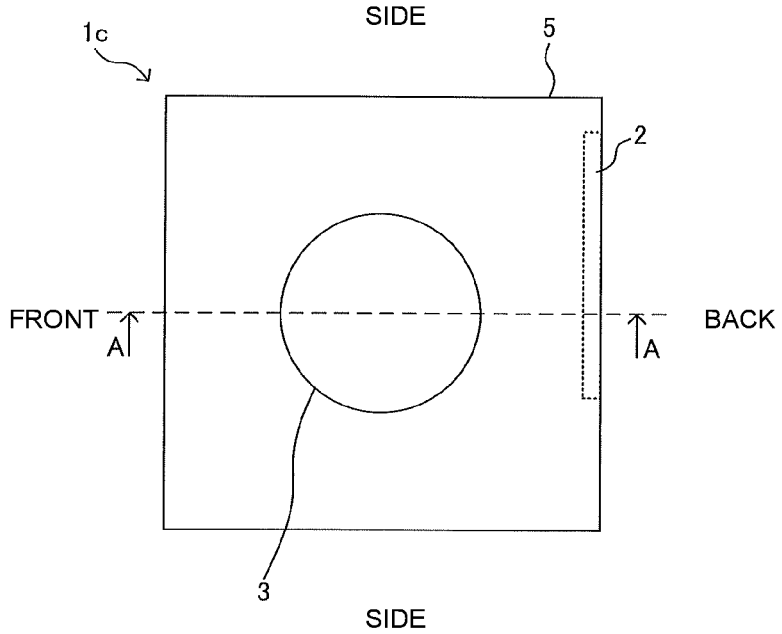
FIG. 8 is a schematic top view of an air-sending device of the air-conditioning apparatus according to Embodiment 1 of the present disclosure.
Figure 9:
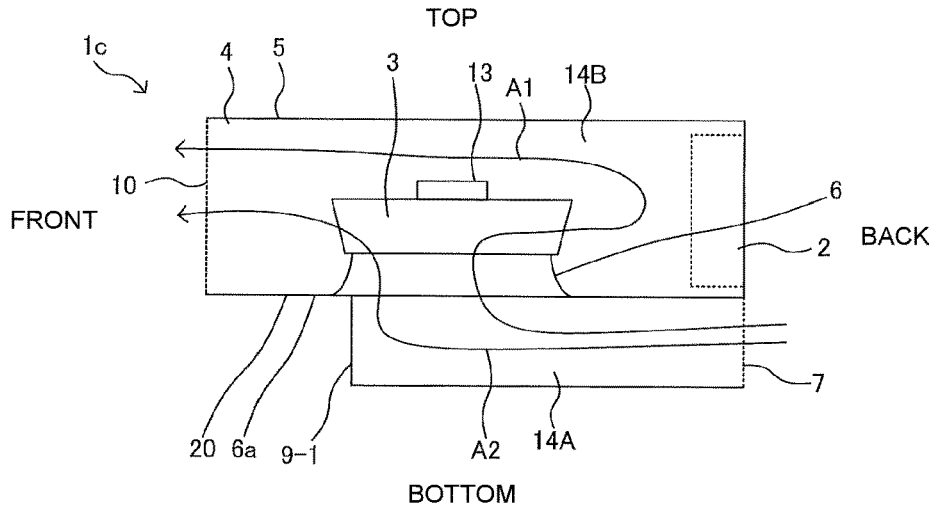
FIG. 9 is an exemplary schematic cross-sectional view taken along A-A in FIG. 8.

FIG. 8 is a schematic top view of an air-sending device 1*c* of the air-conditioning apparatus according to Embodiment 1 of the present disclosure. FIG. 9 is an exemplary schematic cross-sectional view taken along A-A in FIG. 8. Modification 2 included in the air-conditioning apparatus will be described below with reference to FIGS. 8 and 9.

Although the heat source device 1*a*-1 has been described above as an example with reference to FIGS. 1 to 6, and the load-side device 1*b* has been described above as an example with reference to FIG. 7, the same description as above is applicable to the air-sending device 1*c* as illustrated in FIGS. 8 and 9. The air-sending device 1*c* illustrated in FIGS. 8 and 9 corresponds to a device obtained by removing the compressor 1, the heat exchanger 4, and the drain pan 8 from the heat source device 1*a*-1 illustrated in FIGS. 1 to 6. By providing the air-passage partition plate 9-1 to the air-sending device 1*c* with such a configuration, the same effect as described above with reference to the heat source device 1*a*-1 can be obtained for the air-sending device 1*c* as well.

As illustrated in FIG. 9, the wall at the distal end of the inlet air passage 14A may be aligned with the air-passage partition plate 9-1. In other words, the wall at the distal end of the inlet air passage 14A may be used as the air-passage partition plate 9-1. As a result, the same effect as the effect of the air-passage partition plate 9-1 can be obtained by the inlet air passage 14A alone, and the housing 5 can be smaller in size.

<Modification 3>

Figure 10:
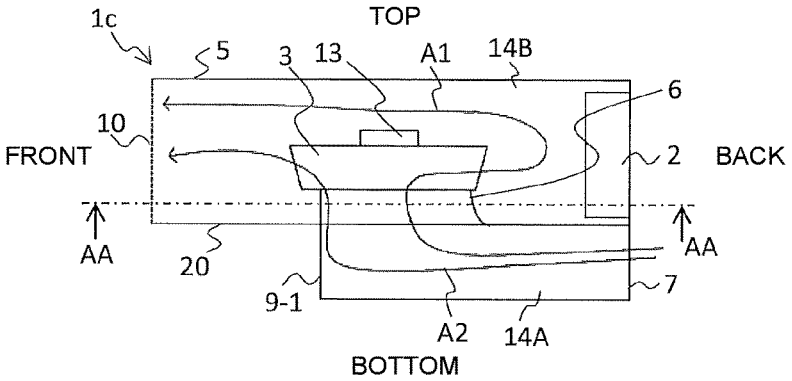
FIG. 10 is an exemplary schematic cross-sectional view taken along A-A in FIG. 8.
Figure 11:
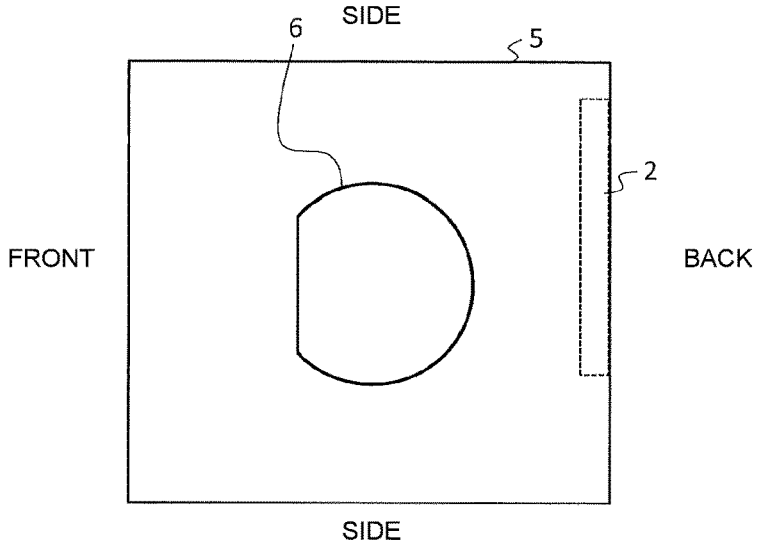
FIG. 11 is an exemplary schematic cross-sectional view taken along AA-AA in FIG. 10.

FIG. 10 is an exemplary schematic cross-sectional view taken along A-A in FIG. 8. FIG. 11 is an exemplary schematic cross-sectional view taken along AA-AA in FIG. 10. The bell mouth 6 in FIGS. 10 and 11 differs from the bell mouth 6 in FIG. 9 in shape. Although the bell mouth in FIG. 9 has a circular cross-section with the air-passage partition plate 9-1 located upstream of the bell mouth, the bell mouth 6 in FIG. 10 has a D-shaped cross-section with the air-passage partition plate 9-1 located on the extension of the straight portion of the D-shape. The bell mouth 6 and the air-passage partition plate 9-1 may be formed as an integrated component. As for the position of each of the straight portion of the bell mouth 6 and the air-passage partition plate 9-1 in the horizontal direction, it is effective to place the straight portion of the bell mouth 6, and the air-passage partition plate 9-1 at the "−10 mm" to "−60 mm" positions as described above.

<Air-Conditioning Apparatus>

Figure 12:
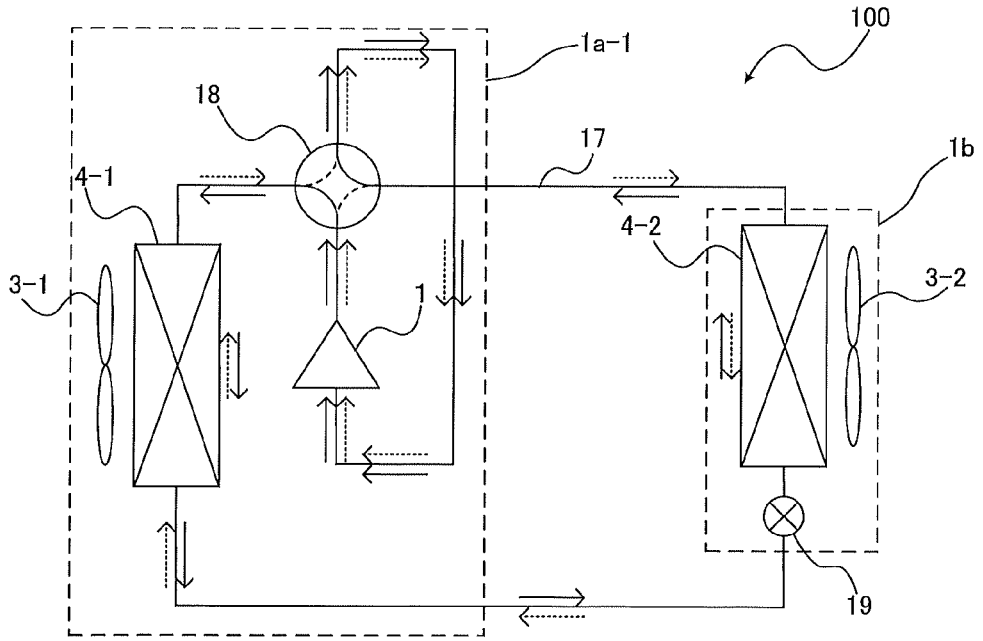
FIG. 12 schematically illustrates an exemplary configuration of a refrigerant circuit of the air-conditioning apparatus according to Embodiment 1 of the present disclosure.

FIG. 12 schematically illustrates an exemplary configuration of a refrigerant circuit of an air-conditioning apparatus 100 according to Embodiment 1 of the present disclosure. The air-conditioning apparatus 100 will be described below with reference to FIG. 12. The air-conditioning apparatus 100 includes at least one of the heat source device 1*a*-1 illustrated in FIGS. 1 to 6, the load-side device 1*b* illustrated in FIG. 7, and the air-sending device 1*c* illustrated in FIGS. 8 and 9. FIG. 12 depicts an exemplary case in which the air-conditioning apparatus 100 includes both the heat source device 1*a*-1 illustrated in FIGS. 1 to 6, and the load-side device 1*b* illustrated in FIG. 7.

FIG. 12 depicts an example of the air-conditioning apparatus 100 capable of switching the flows of refrigerant. In FIG. 12, solid arrows represent the flow of refrigerant when a heat exchanger 4-1 is used as a condenser and a heat exchanger 4-2 is used as an evaporator, and dashed arrows represent the flow of refrigerant when the heat exchanger 4-1 is used as an evaporator and the heat exchanger 4-2 is used as a condenser. In FIG. 12, the heat exchanger 4 incorporated in the heat source device 1*a*-1, and the heat exchanger 4 incorporated in the load-side device 1*b* are distinguished from each other and respectively represented as the heat exchanger 4-1 and the heat exchanger 4-2. Further, in FIG. 12, the impeller 3 incorporated in the heat source device 1*a*-1, and the impeller 3 incorporated in the load-side device 1*b* are distinguished from each other and respectively represented as an impeller 3-1 and an impeller 3-2.

As illustrated in FIG. 12, the air-conditioning apparatus 100 includes a refrigerant circuit obtained by connecting the following components by a refrigerant pipe 17: the compressor 1, a flow switching device 18, the heat exchanger 4-1, a pressure reducing device 19, and the heat exchanger 4-2.

Although the present example is directed to a case in which the flow switching device 18 is provided to enable switching of refrigerant flows, the flow switching device 18 may not be provided and refrigerant may flow in a fixed direction. When the flow switching device 18 is not provided, the heat exchanger 4-2 is used only as a condenser, and the heat exchanger 4-2 is used only as an evaporator.

The compressor 1, the flow switching device 18, the heat exchanger 4-1, and the impeller 3-1 are incorporated in the heat source device 1*a*-1. The heat source device 1*a*-1 is installed in a space different from the air-conditioned space, for example, in an outdoor space to thereby supply cooling enemy or heating energy to the load-side device 1*b*.

The pressure reducing device 19, the heat exchanger 4-2, and the impeller 3-2 are incorporated in the load-side device 1*b*. The load-side device 1*b* is installed in a space for supplying cooling energy or heating energy to the air-conditioned space, for example, in an indoor space to thereby cool or heat the air-conditioned space with the cooling energy or heating energy supplied from the heat source device 1*a*-1.

The compressor 1 compresses refrigerant, and discharges the compressed refrigerant. The compressor 1 may be, for example, a rotary compressor, a scroll compressor, a screw compressor, or a reciprocating compressor. When the heat exchanger 4-1 is used as a condenser, refrigerant discharged from the compressor 1 is sent to the heat exchanger 4-1. When the heat exchanger 4-1 is used as an evaporator, refrigerant discharged from the compressor 1 is sent to the heat exchanger 4-2.

The flow switching device 18 is provided to the discharge portion of the compressor 1 to switch the flows of refrigerant between heating and cooling operations. The flow switching device 18 may be, for example, a four-way valve, a combination of three-way valves, or a combination of two-way valves.

The heat exchanger 4-1, which is used as a condenser or an evaporator, may be, for example, a fin-and-tube heat exchanger.

The pressure reducing device 19 reduces the pressure of refrigerant that has passed through the heat exchanger 4-1 or the heat exchanger 4-2. The pressure reducing device 19 may be, for example, an electronic expansion valve or a capillary tube. The pressure reducing device 19 may be incorporated not in the load-side device 1*b* but in the heat source device 1*a*-1.

The heat exchanger 4-2, which is used as an evaporator or a condenser, may be, for example, a fin-and-tube heat exchanger.

Operation of the air-conditioning apparatus 100 will be described below together with the flow of refrigerant.

First, cooling operation, that is, operation when the heat exchanger 4-1 is used as a condenser will be described.

As the compressor 1 is driven, high-temperature and high-pressure refrigerant in a gaseous state is discharged from the compressor 1. Subsequently, the refrigerant flows as represented by solid arrows. The high-temperature and high-pressure gas refrigerant discharged from the compressor 1 flows into the heat exchanger 4-1 via the flow switching device 18. In the heat exchanger 4-1, heat is exchanged between the incoming high-temperature and high-pressure gas refrigerant, and air supplied by the impeller 3-1, and the high-temperature and high-pressure gas refrigerant thus condenses into high-pressure liquid refrigerant.

The high-pressure liquid refrigerant leaving the heat exchanger 4-1 is changed by the pressure reducing device 19 into low-pressure refrigerant in a two-phase gas-liquid state including a gas refrigerant portion and a liquid refrigerant portion. The two-phase gas-liquid refrigerant flows into the heat exchanger 4-2 being used as an evaporator. In the heat exchanger 4-2, heat is exchanged between the incoming two-phase gas-liquid refrigerant, and air supplied by the impeller 3-2, and the liquid refrigerant portion of the two-phase gas-liquid refrigerant thus evaporates into low-pressure gas refrigerant. The low-pressure gas refrigerant leaving the heat exchanger 4-2 is suctioned via the flow switching device 18 into the compressor 1, where the low-pressure gas refrigerant is compressed into high-temperature and high-pressure gas refrigerant, which is then discharged from the compressor 1 again. Subsequently, this cycle is repeated.

Next, heating operation, that is, operation when the heat exchanger 4-1 is used as an evaporator will be described.

As the compressor 1 is driven, high-temperature and high-pressure refrigerant in a gaseous state is discharged from the compressor 1. Subsequently, the refrigerant flows as represented by dashed arrows. The high-temperature and high-pressure gas refrigerant discharged from the compressor 1 flows into the heat exchanger 4-2 via the flow switching device 18. In the heat exchanger 4-2, heat is exchanged between the incoming high-temperature and high-pressure gas refrigerant, and air supplied by the impeller 3-2, and the high-temperature and high-pressure gas refrigerant thus condenses into high-pressure liquid refrigerant.

The high-pressure liquid refrigerant leaving the heat exchanger 4-2 is changed by the pressure reducing device 19 into low-pressure refrigerant in a two-phase gas-liquid state including a gas refrigerant portion and a liquid refrigerant portion. The two-phase gas-liquid refrigerant flows into the heat exchanger 4-1. In the heat exchanger 4-1, heat is exchanged between the incoming two-phase gas-liquid refrigerant, and air supplied by the impeller 3-1, and the liquid refrigerant portion of the two-phase gas-liquid refrigerant thus evaporates into low-pressure gas refrigerant. The low-pressure gas refrigerant leaving the heat exchanger 4-1 is suctioned via the flow switching device 18 into the compressor 1, where the low-pressure gas refrigerant is compressed into high-temperature and high-pressure gas refrigerant, which is then discharged from the compressor 1 again. Subsequently, this cycle is repeated.

As described above, the air-conditioning apparatus 100 includes at least one of the heat source device 1*a*-1, the load-side device 1*b*, and the air-sending device 1*c*, and both reduced fan input and reduced noise are thus to be achieved.

Embodiment 2

Embodiment 2 of the present disclosure will be described below. In Embodiment 2, descriptions overlapping descriptions given with reference to Embodiment 1 will be omitted, and features identical or corresponding to features of Embodiment 1 will be designated by the same reference signs.

Figure 13:
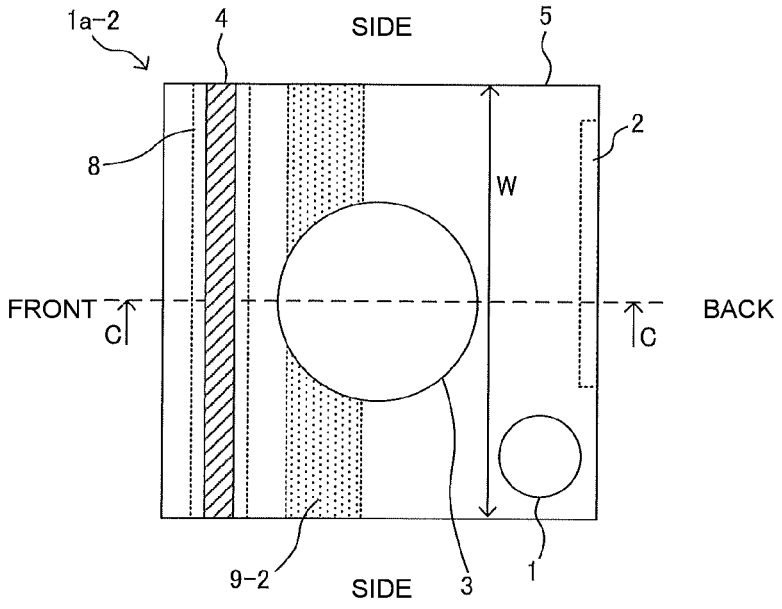
FIG. 13 is a schematic top view of a heat source device of an air-conditioning apparatus according to Embodiment 2 of the present disclosure.
Figure 14:
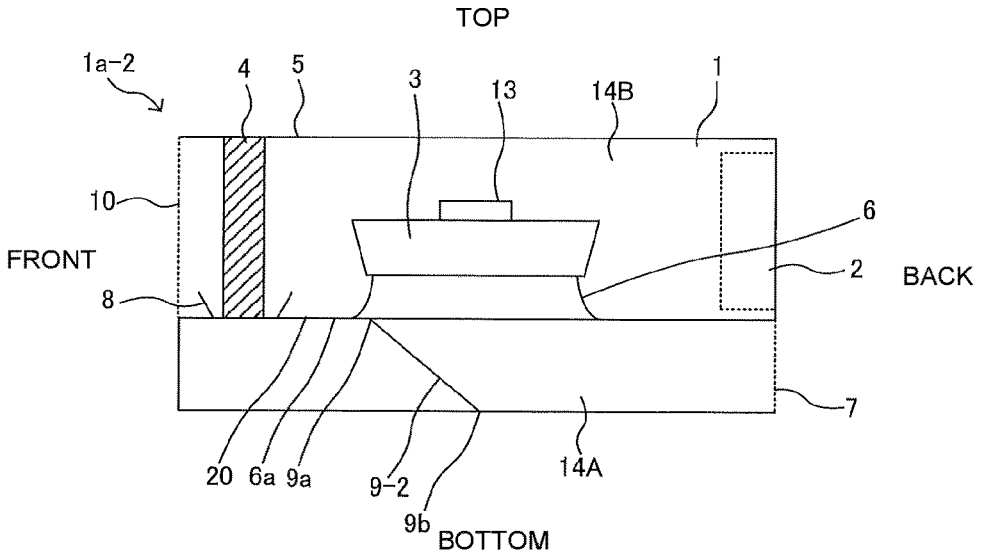
FIG. 14 is an exemplary schematic cross-sectional view taken along C-C in FIG. 13.

FIG. 13 is a schematic top view of a heat source unit 1*a*-2 of an air-conditioning apparatus according to Embodiment 2 of the present disclosure. FIG. 14 is an exemplary schematic cross-sectional view taken along C-C in FIG. 13. The heat source unit 1*a*-2 will be described below with reference to FIGS. 13 and 14. FIG. 13 schematically depicts the interior of the heat source unit 1*a*-2. Further, FIGS. 13 and 14 depict an exemplary state in which the right in FIGS. 13 and 14 corresponds to the back of the heat source unit 1*a*-2, and the left in FIGS. 13 and 14 corresponds to the front of the heat source unit 1*a*-2.

Although Embodiment 1 described above is directed to an exemplary case in which the air-passage partition plate 9-1 is disposed vertically, in Embodiment 2, an air-passage partition plate 9-2 is disposed in an inclined manner. An end portion 9*a* of the air-passage partition plate 9-2, which is an end portion close to the bell mouth 6, that is, an upper end portion of the air-passage partition plate 9-2 in FIG. 14, is positioned closer to the air inlet 7 than is the end portion 6*a* of the bell mouth 6. An end portion 9*b* of the air-passage partition plate 9-2, which is an end portion close to the bottom of the inlet air passage 14A, that is, a lower end portion of the air-passage partition plate 9-2 in FIG. 14, is positioned closer to the air inlet 7 than is the end portion 9*a*. Being disposed in an inclined manner means being disposed in such a manner that a wall surface of the air-passage partition plate 9-2 that faces the inlet air passage 14A extends obliquely to the bottom of the inlet air passage 14A.

Figure 15:
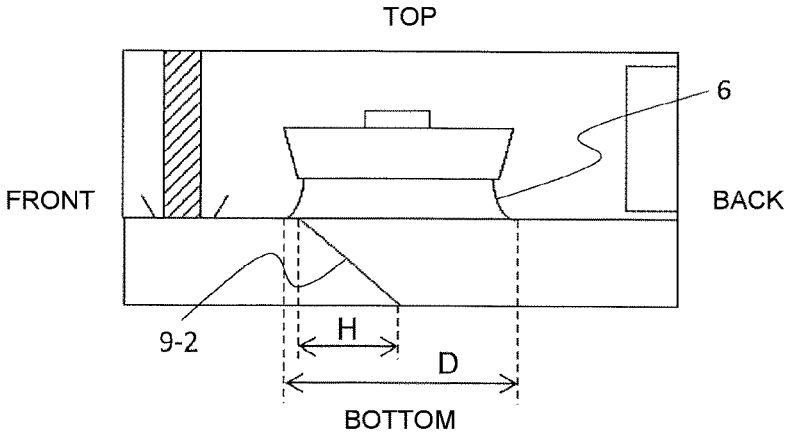
FIG. 15 is an illustration for explaining an effect of Embodiment 2.
Figure 16:
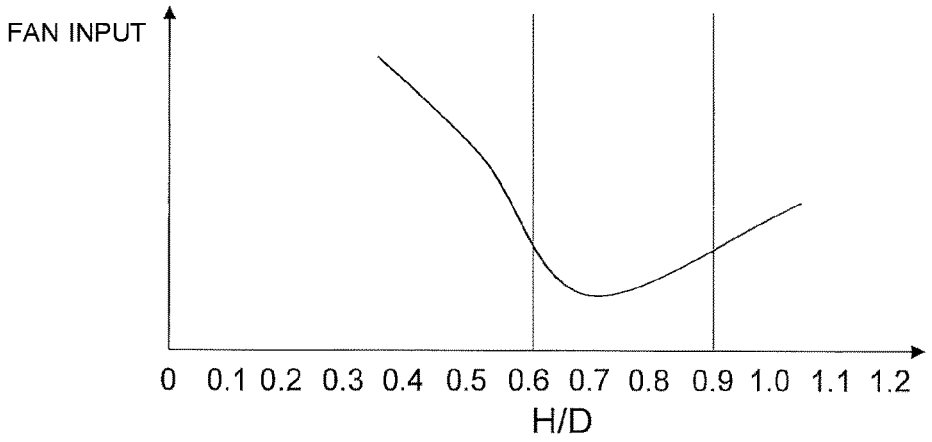
FIG. 16 illustrates the relationship between H/D and fan input according to Embodiment 2.
Figure 17:
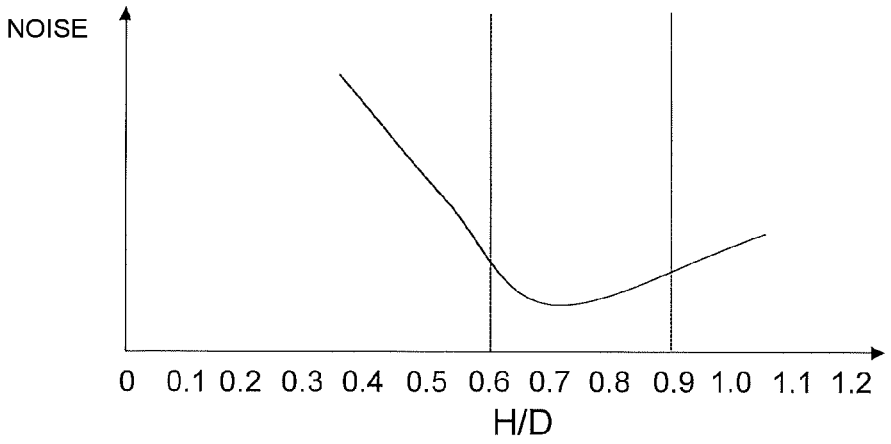
FIG. 17 illustrates the relationship between H/D and noise according to Embodiment 2.

With reference to FIGS. 15, 16, and 17, the relationship between the angle and effect of the air-passage partition plate 9-2 will be described. FIG. 15 is a cross-sectional view taken along C-C in FIG. 13, illustrating the major dimensions to be considered in determining the angle of the air-passage partition plate 9-2. In FIG. 15, D denotes the diameter of a portion of the bell mouth 6 that is close to the air inlet, and H denotes the length in the horizontal direction of the air-passage partition plate 9-2. FIG. 16 illustrates the relationship between H/D and fan input, and FIG. 17 illustrates the relationship between H/D and noise. When H/D is in the vicinity of 0.4, fan input and noise are both large, and when H/D is in the vicinity of 0.7, fan input and noise are each at the minimum. Once H/D is greater than or equal to 0.7, fan input and noise slowly increase. Therefore, the dimension H of the air-passage partition plate 9-2 is desirably within a range of about 0.6 to 0.9 times the dimension D.

As with the air-passage partition plate 9-1, the air-passage partition plate 9-2 is detachably disposed in the inlet air passage 14A and partitions the inlet air passage 14A into left and right areas. In other words, the inlet air passage 14A is blocked at a point by the air-passage partition plate 9-2. The air-passage partition plate 9-2 is equal in width to the inlet air passage 14A. Thus, the inlet air passage 14A is defined in a lower portion of the housing 5 by the wall surface of the housing 5 and the air-passage partition plate 9-2, which is placed facing the air inlet 7. The inlet air passage 14A communicates with the air inlet 7 to guide air admitted through the air inlet 7 to the bell mouth 6.

The air-passage partition plate 9-2 will be described below in detail.

Figure 18:
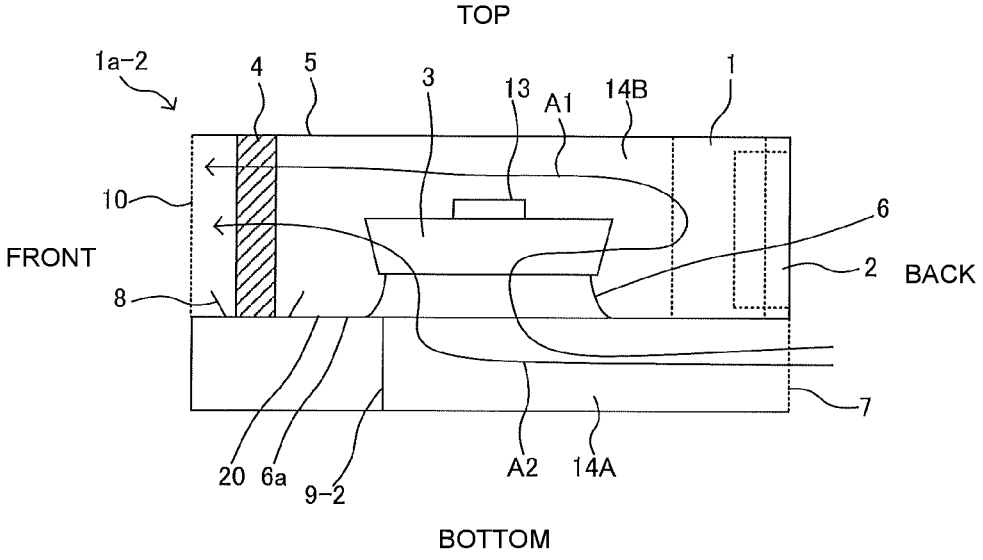
FIG. 18 schematically illustrates how air flows in an inlet air passage when an air-passage partition plate is disposed vertically.
Figure 19:
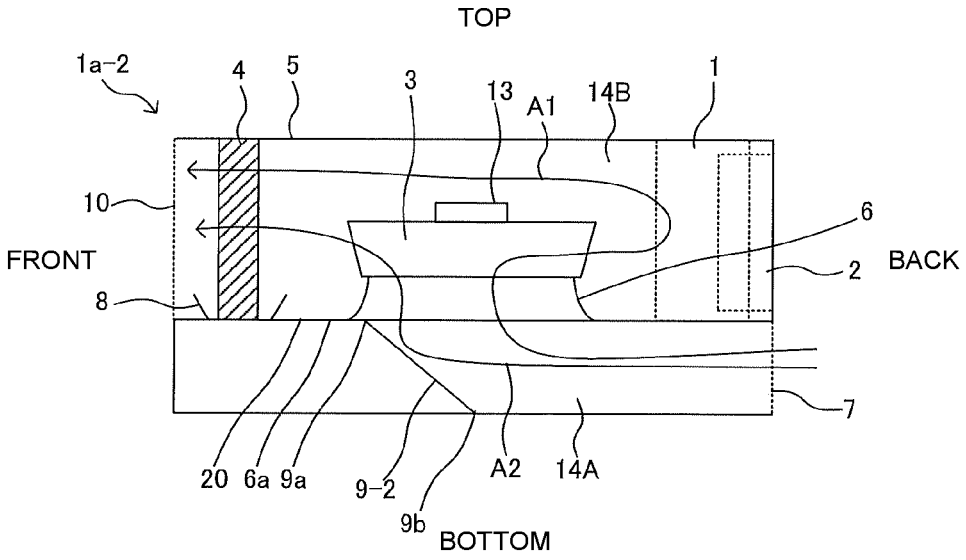
FIG. 19 schematically illustrates how air flows in an inlet air passage when an air-passage partition plate is disposed in an inclined manner.

FIG. 18 schematically illustrates how air flows in the inlet air passage 14A when the air-passage partition plate 9-2 is disposed vertically. FIG. 19 schematically illustrates how air flows in the inlet air passage 14A when the air-passage partition plate 9-2 is disposed in an inclined manner. FIGS. 18 and 19 each schematically depict an exemplary cross-section taken along C-C in FIG. 13. In FIGS. 18 and 19, the arrow A1 and the arrow A2 each represent the flow of air. Disposing the air-passage partition plate 9-2 vertically means disposing the air-passage partition plate 9-2 in the same manner as the manner in which the air-passage partition plate 9-1 described above with reference to Embodiment 1 is disposed.

When the inlet air passage 14A is shaped as illustrated in FIG. 18, air suctioned in through the air inlet 7 collides at a substantially right angle with the air-passage partition plate 9-2, and is then directed along the inner surface of the bell mouth 6.

By contrast, when the inlet air passage 14A is shaped as illustrated in FIG. 19, air suctioned in through the air inlet 7 collides with the air-passage partition plate 9-2 at an obtuse angle, and the resistance to the passage of air is thus reduced in the inlet air passage 14A.

Therefore, as compared with disposing the air-passage partition plate 9-2 vertically, disposing the air-passage partition plate 9-2 in an inclined manner as illustrated in FIG. 19 helps reduce the rotation frequency of the impeller 3 required for obtaining the same rate of airflow, and thus makes it possible to reduce fan input and noise. Disposing the air-passage partition plate 9-2 in an inclined manner is particularly effective for an operating point on the open end, that is, the suction portion of the impeller 3. Further, the heat source device 1*a*-2 configured as described above eliminates the need to employ a complicated structure. This configuration ensures improved robustness, and makes it possible to reduce a decrease in the ease of construction and an increase in cost.

The air-passage partition plate 9-2 corresponds to "air-passage wall".

As with Embodiment 1, the air-passage partition plate 9-2 disposed in an inclined manner can be applied to a load-side device. In this case, the compressor 1 is only required to be removed from the heat source device 1*a*-2. The same effect as mentioned above can be thus obtained for the load-side device as well. Further, as with Embodiment 1, the air-passage partition plate 9-2 disposed in an inclined manner can be applied to an air-sending device. In this case, the compressor 1, the heat exchanger 4, and the drain pan 8 are only required to be removed from the heat source device 1*a*-2. The same effect as mentioned above can be thus obtained for the air-sending device as well.

The air-conditioning apparatus according to Embodiment 2 of the present disclosure includes at least one of the following devices employing the air-passage partition plate 9-2 disposed in an inclined manner: the heat source device 1*a*-2, a load-side device, and an air-sending device. As described above, the air-conditioning apparatus according to Embodiment 2 of the present disclosure includes at least one of the heat source device 1*a*-2, a load-side device, and an air-sending device, and both reduced fan input and reduced noise are thus to be achieved. One exemplary configuration of the air-conditioning apparatus according to Embodiment 2 of the present disclosure is the air-conditioning apparatus 100 according to Embodiment 1.

Embodiment 3

Embodiment 3 of the present disclosure will be described below. In Embodiment 3, descriptions overlapping descriptions given with reference to Embodiments 1 and 2 will be omitted, and features identical or corresponding to features of Embodiments 1 and 2 will be designated by the same reference signs.

Figure 20:
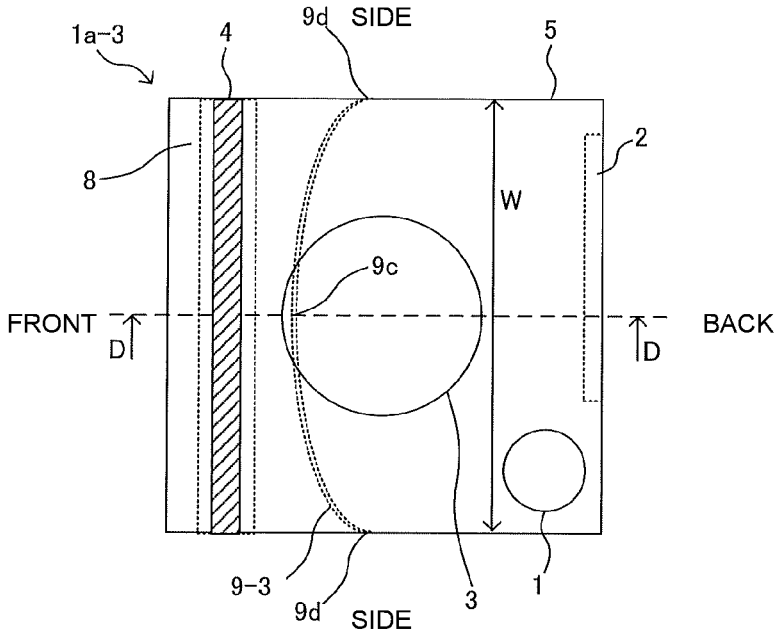
FIG. 20 is a schematic top view of a heat source device of an air-conditioning apparatus according to Embodiment 3 of the present disclosure.
Figure 21:
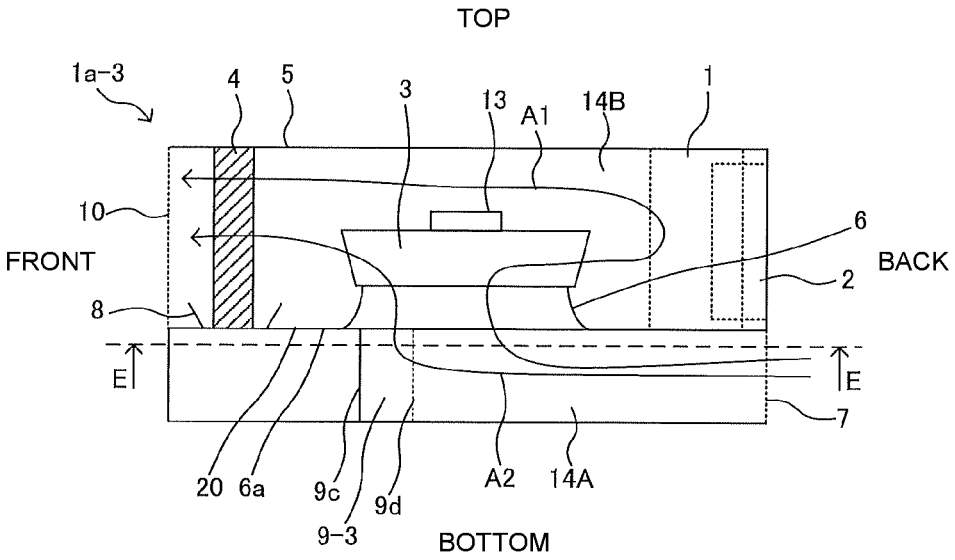
FIG. 21 is an exemplary schematic cross-sectional view taken along D-D in FIG. 20.
Figure 22:
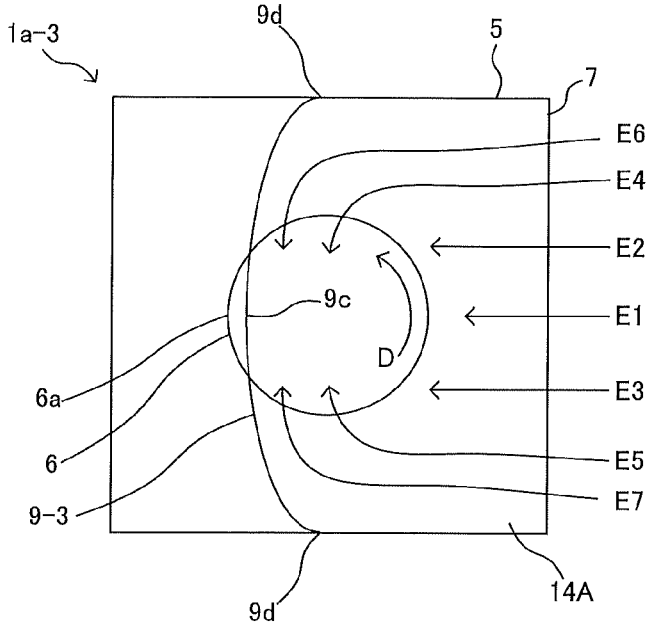
FIG. 22 is an exemplary schematic cross-sectional view taken along E-E in FIG. 21.

FIG. 20 is a schematic top view of a heat source unit 1*a*-3 of an air-conditioning apparatus according to Embodiment 3 of the present disclosure. FIG. 21 is an exemplary schematic cross-sectional view taken along D-D in FIG. 20. FIG. 22 is an exemplary schematic cross-sectional view taken along E-E in FIG. 21. The heat source unit 1*a*-3 will be described below with reference to FIGS. 20 to 22. FIG. 20 schematically depicts the interior of the heat source unit 1*a*-3. Further, FIGS. 20 to 22 depict an exemplary state in which the right in FIGS. 20 to 22 corresponds to the back of the heat source unit 1*a*-3, and the left in FIGS. 20 to 22 corresponds to the front of the heat source unit 1*a*-3. In FIG. 22, arrows E1 to E7 each represent the flow of air.

Although Embodiment 1 described above is directed to an exemplary case in which the air-passage partition plate 9-1 is disposed vertically, in Embodiment 3, an air-passage partition plate 9-3 in a curved shape is disposed vertically. The air-passage partition plate 9-3 is curved in such a manner that a central portion 9*c* of the air-passage partition plate 9-3 illustrated in FIG. 20 is located farther from the air inlet 7 than is an end portion 9*d* depicted at each of the top and bottom in FIG. 20. In other words, the air-passage partition plate 9-3 is formed in a curved shape convex in the downstream direction of air flowing in the inlet air passage 14A, and extends in the widthwise direction of the inlet air passage 14A. Thus, the inlet air passage 14A is defined in a lower portion of the housing 5 by the wall surface of the housing 5 and the air-passage partition plate 9-3, which is placed facing the air inlet 7. The inlet air passage 14A communicates with the air inlet 7 to guide air admitted through the air inlet 7 to the bell mouth 6.

As with the air-passage partition plate 9-1, the air-passage partition plate 9-3 is detachably disposed in the inlet air passage 14A and partitions the inlet air passage 14A into left and right areas. In other words, the inlet air passage 14A is blocked at a point by the air-passage partition plate 9-3. The air-passage partition plate 9-3 is equal in height to the inlet air passage 14A. Being disposed vertically means being disposed in such a manner that a wall surface of the air-passage partition plate 9-3 that faces the inlet air passage 14A extends perpendicularly to the bottom of the inlet air passage 14A.

The air-passage partition plate 9-3 will be described below in detail.

The central portion 9*c* of the air-passage partition plate 9-3 is the portion of the air-passage partition plate 9-3 farthest from the air inlet 7, and located closer to the air inlet 7 than is the end portion 6*a* of the bell mouth 6. The air-passage partition plate 9-3 is curved gently in a symmetrical fashion toward the end portions 9*d* that are opposite widthwise.

The above-mentioned configuration ensures that air entering through each side of the air inlet 7 as represented by the arrows E6 and E7 is smoothly guided into the bell mouth 6, and the resistance to the passage of air is thus reduced.

Therefore, as compared with disposing the air-passage partition plate 9-1 vertically, forming the air-passage partition plate 9-3 in a curved shape helps reduce the rotation frequency of the impeller 3 required for obtaining the same rate of airflow, and thus makes it possible to reduce fan input and noise. Further, the heat source device 1*a*-3 configured as described above eliminates the need to employ a complicated structure. This configuration ensures improved robustness, and makes it possible to reduce a decrease in the ease of construction and an increase in cost.

The air-passage partition plate 9-3 corresponds to "air-passage wall".

As with Embodiment 1, the air-passage partition plate 9-3 in a curved shape can be applied to a load-side device. In this case, the compressor 1 is only required to be removed from the heat source device 1*a*-3. The same effect as mentioned above can be thus obtained for the load-side device as well. Further, as with Embodiment 1, the air-passage partition plate 9-3 in a curved shape can be applied to an air-sending device. In this case, the compressor 1, the heat exchanger 4, and the drain pan 8 are only required to be removed from the heat source device 1*a*-3. The same effect as mentioned above can be thus obtained for the air-sending device as well.

The air-conditioning apparatus according to Embodiment 3 of the present disclosure includes at least one of the following devices employing the air-passage partition plate 9-3 in a curved shape: the heat source device 1*a*-3, a load-side device, and an air-sending device. As described above, the air-conditioning apparatus according to Embodiment 3 of the present disclosure includes at least one of the heat source device 1*a*-3, a load-side device, and an air-sending device, and both reduced fan input and reduced noise are thus to be achieved. One exemplary configuration of the air-conditioning apparatus according to Embodiment 3 of the present disclosure is the air-conditioning apparatus 100 according to Embodiment 1.

Embodiment 4

Embodiment 4 of the present disclosure will be described below. In Embodiment 4, descriptions overlapping descriptions given with reference to Embodiments 1 to 3 will be omitted, and features identical or corresponding to features of Embodiments 1 to 3 will be designated by the same reference signs.

Figure 23:
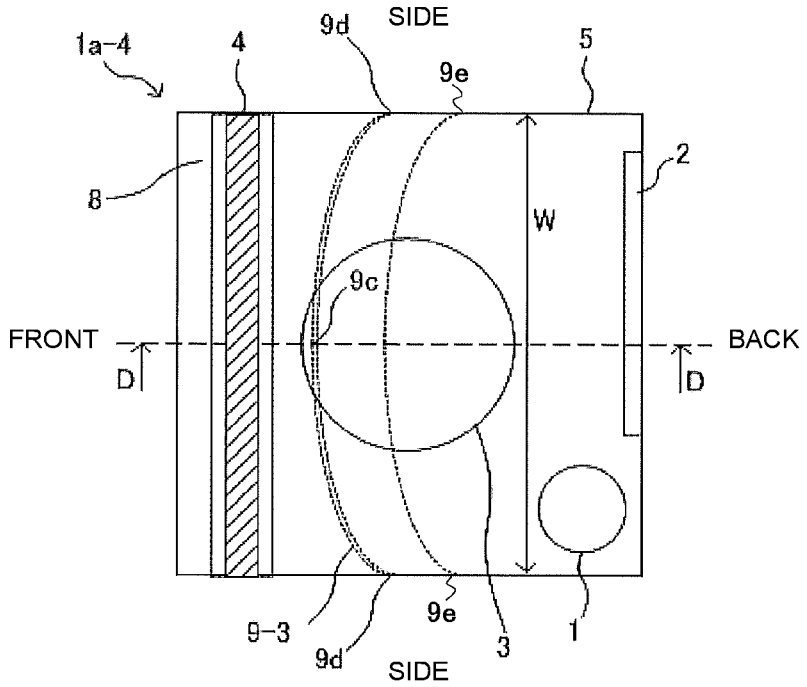
FIG. 23 is a schematic top view of a heat source device of an air-conditioning apparatus according to Embodiment 4 of the present disclosure.
Figure 24:
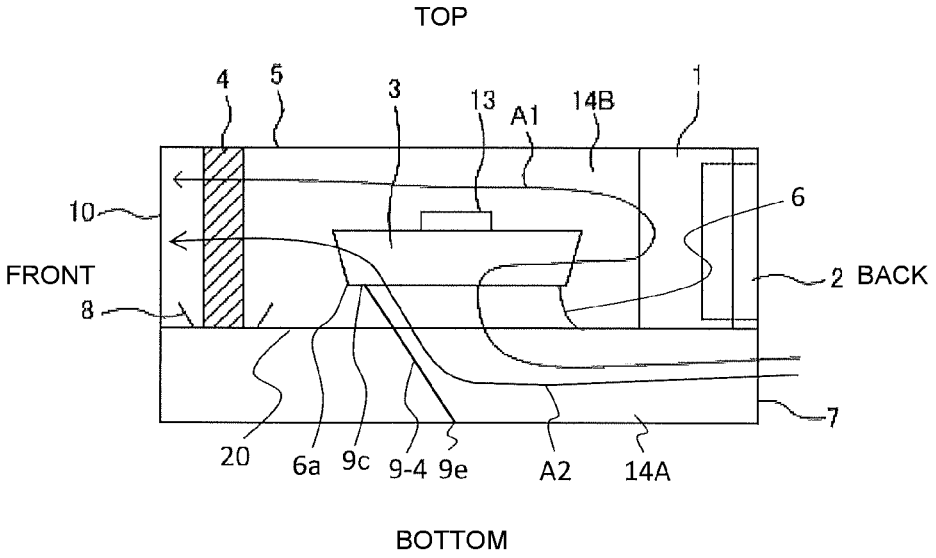
FIG. 24 is an exemplary schematic cross-sectional view taken along D-D in FIG. 23.

FIG. 23 is a schematic top view of a heat source unit 1*a*-4 of an air-conditioning apparatus according to Embodiment 4 of the present disclosure. FIG. 24 is an exemplary schematic cross-sectional view taken along D-D in FIG. 23. The heat source unit 1*a*-4 will be described below with reference to FIGS. 23 and 24. Further, FIG. 23 depicts an exemplary state in which the right in FIG. 23 corresponds to the back of the heat source unit 1*a*-4, and the left in FIG. 23 corresponds to the front of the heat source unit 1*a*-4.

Although Embodiment 3 described above is directed to an exemplary case in which the air-passage partition plate 9-3 in a curved shape is disposed vertically, in Embodiment 4, an air-passage partition plate 9-4 in a curved shape is disposed obliquely to the bottom plate of the housing 5. An end portion of the air-passage partition plate 9-4 that is close to the bell mouth 6 is curved in such a manner that the central portion 9*c* illustrated in FIG. 23 is located farther from the air inlet 7 than is the end portion 9*d* depicted at each of the top and bottom in FIG. 23. As with the end portion close to the bell mouth 6, an end portion of the air-passage partition plate 9-4 that is close to the bottom face of the housing 5 is also curved in such a manner that the central portion of the air-passage partition plate 9-4 is located farther from the air inlet 7 than is the end portion 9*e* depicted at each of the top and bottom in FIG. 23. In other words, the air-passage partition plate 9-4 is formed in a curved shape convex in the downstream direction of air flowing in the inlet air passage 14A, and extends in the widthwise direction of the inlet air passage 14A.

FIG. 24 is a cross-sectional view taken along D-D in FIG. 23. As with the air-passage partition plate 9-3, the air-passage partition plate 9-4 is detachably disposed in the inlet air passage 14A and partitions the inlet air passage 14A into left and right areas. In other words, the inlet air passage 14A is blocked at a point by the air-passage partition plate 9-4. A portion of the air-passage partition plate 9-4 located in the interior of the bell mouth has a height that is between the height of the inlet air passage 14A and the height from the bottom face of the housing to the downstream end portion of the bell mouth. A portion of the air-passage partition plate 9-4 excluding the portion located in the interior of the bell mouth has a height equal to the height of the inlet air passage 14A.

The air-passage partition plate 9-4 will be described below in detail.

The air-passage partition plate 9-4 has the central portion 9*c* of an end portion that is close to the bell mouth, which is located farthest from the air inlet 7. The central portion 9*c* is located closer to the air inlet 7 than is the end portion 6*a* of the bell mouth 6. The end portion of the air-passage partition plate 9-4 that is close to the bell mouth is curved gently in a symmetrical fashion toward the end portions 9*d* that are opposite widthwise. An end portion of the air-passage partition plate 9-4 that is close to the bottom plate of the housing is located closer to the air inlet 7 than is the end portion close to the bell mouth.

The above-mentioned configuration ensures that air entering through each side of the air inlet 7 is smoothly guided by the air-passage partition plate 9-4 from the inlet air passage 14A to the end portion 6*a* of the bell mouth 6, and the resistance to the passage of air is thus reduced.

Therefore, as compared with disposing the air-passage partition plate 9-3 vertically, the above-mentioned configuration helps reduce the rotation frequency of the impeller 3 required for obtaining the same rate of airflow, and thus makes it possible to reduce fan input and noise.

The air-passage partition plate 9-4 corresponds to "air-passage wall".

As with Embodiment 1, the air-passage partition plate 9-4 in a curved shape can be applied to a load-side device. In this case, the compressor 1 is only required to be removed from the heat source device 1*a*-4. The same effect as mentioned above can be thus obtained for the load-side device as well. Further, as with Embodiment 1, the air-passage partition plate 9-4 in a curved shape can be applied to an air-sending device. In this case, the compressor 1, the heat exchanger 4, and the drain pan 8 are only required to be removed from the heat source device 1*a*-4. The same effect as mentioned above can be thus obtained for the air-sending device as well.

Embodiment 5

Embodiment 5 of the present disclosure will be described below. In Embodiment 5, descriptions overlapping descriptions given with reference to Embodiments 1 to 4 will be omitted, and features identical or corresponding to features of Embodiments 1 to 4 will be designated by the same reference signs.

Figure 25:
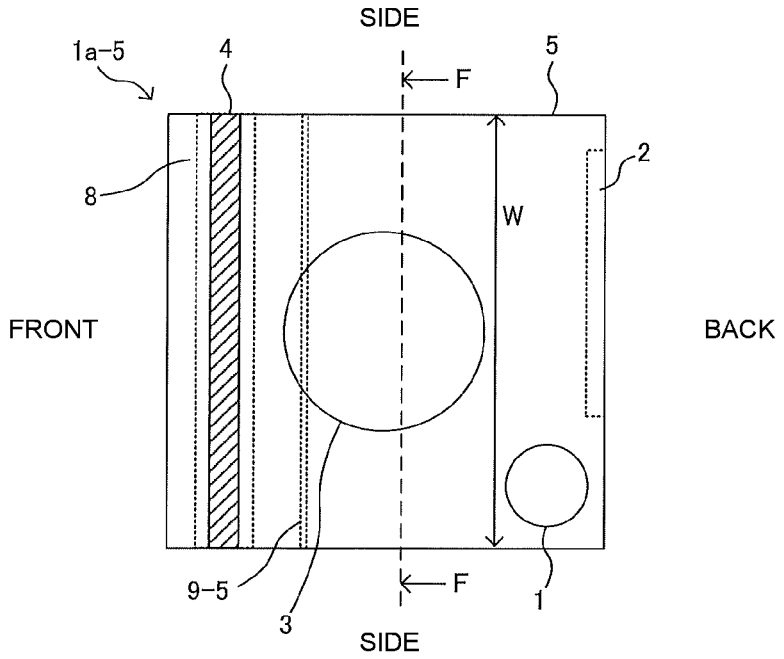
FIG. 25 is a schematic top view of a heat source device of an air-conditioning apparatus according to Embodiment 5 of the present disclosure.
Figure 26:
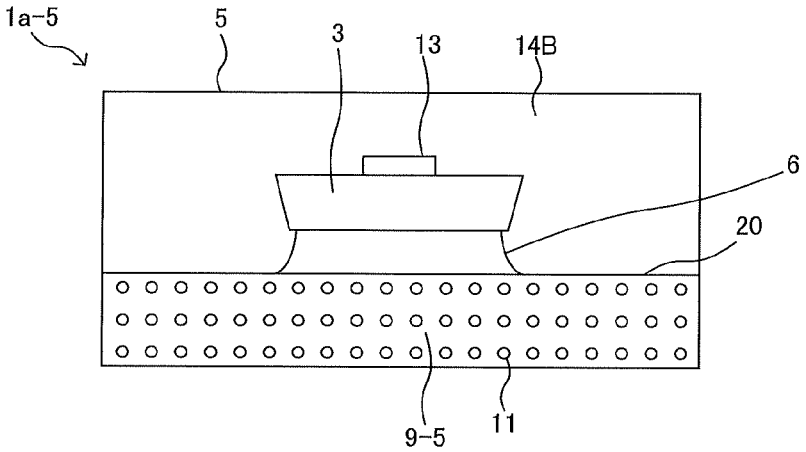
FIG. 26 is an exemplary schematic cross-sectional view taken along F-F in FIG. 25.

FIG. 25 is a schematic top view of a heat source unit 1*a*-5 of an air-conditioning apparatus according to Embodiment 5 of the present disclosure. FIG. 26 is an exemplary schematic cross-sectional view taken along F-F in FIG. 25. The heat source unit 1*a*-5 will be described below with reference to FIGS. 25 and 26. FIG. 25 schematically depicts the interior of the heat source unit 1*a*-5. Further, FIG. 25 depicts an exemplary state in which the right in FIG. 25 corresponds to the back of the heat source unit 1*a*-5, and the left in FIG. 25 corresponds to the front of the heat source unit 1*a*-5.

An air-passage partition plate 9-5 will be described below in detail.

In Embodiment 5, the air-passage partition plate 9-5 provided with plural fine holes 11 is disposed vertically or in an inclined manner. More specifically, each fine hole 11 in the air-passage partition plate 9-5, and the air layer in the space behind the air-passage partition plate 9-5 are used to form a Helmholtz resonator. The inlet air passage 14A is defined in a lower portion of the housing 5 by the wall of the housing 5 and the air-passage partition plate 9-5, which is placed facing the air inlet 7. The inlet air passage 14A communicates with the air inlet 7 to guide air admitted from the air inlet 7 to the bell mouth 6.

The size and pitch of each individual fine hole 11 are designed in such a manner that air passing through the interior of the fine hole 11 vibrates in a band of frequencies that are desired to be reduced. The space behind the air-passage partition plate 9-5 means a space in the inlet air passage 14A that is partitioned off by the air-passage partition plate 9-5 and not located close to the air inlet 7.

The above-mentioned configuration makes it possible to further reduce noise.

Therefore, as compared with the air-passage partition plates 9-1 to 9-4 with no fine hole 11, the air-passage partition plate 9-5 provided with the fine holes 11 provides the same effect as the effect of the above-mentioned air-passage partition plates, and also makes it possible to further reduce noise. Embodiment 5 is particularly effective in reducing noise below or equal to 1000 Hz. Providing each of the air-passage partition plates 9-1 to 9-4 with the fine holes 11 makes it possible to further reduce noise. Further, the heat source device 1*a*-5 configured as described above eliminates the need to employ a complicated structure. This configuration ensures improved robustness, and makes it possible to reduce a decrease in the ease of construction and an increase in cost.

The air-passage partition plate 9-5 corresponds to "air-passage wall".

As with Embodiment 1, the air-passage partition plate 9-5 provided with the fine holes 11 can be applied to a load-side device. In this case, the compressor 1 is only required to be removed from the heat source device 1*a*-5. The same effect as mentioned above can be thus obtained for the load-side device as well. As with Embodiment 1, the air-passage partition plate 9-5 provided with the fine holes 11 can be applied to an air-sending device. In this case, the compressor 1, the heat exchanger 4, and the drain pan 8 are only required to be removed from the heat source device 1*a*-5. The same effect as mentioned above can be thus obtained for the air-sending device as well.

The air-conditioning apparatus according to Embodiment 5 of the present disclosure includes at least one of the following devices employing the air-passage partition plate 9-5 provided with the fine holes 11: the heat source device 1*a*-5, a load-side device, and an air-sending device. As described above, the air-conditioning apparatus according to Embodiment 5 of the present disclosure includes at least one of the heat source device 1*a*-5, a load-side device, and an air-sending device, and both reduced fan input and reduced noise are thus to be achieved. One exemplary configuration of the air-conditioning apparatus according to Embodiment 5 of the present disclosure is the air-conditioning apparatus 100 according to Embodiment 1.

Embodiment 6

Embodiment 6 of the present disclosure will be described below. In Embodiment 6, descriptions overlapping descriptions given with reference to Embodiments 1 to 5 will be omitted, and features identical or corresponding to features of Embodiments 1 to 5 will be designated by the same reference signs.

Figure 27:
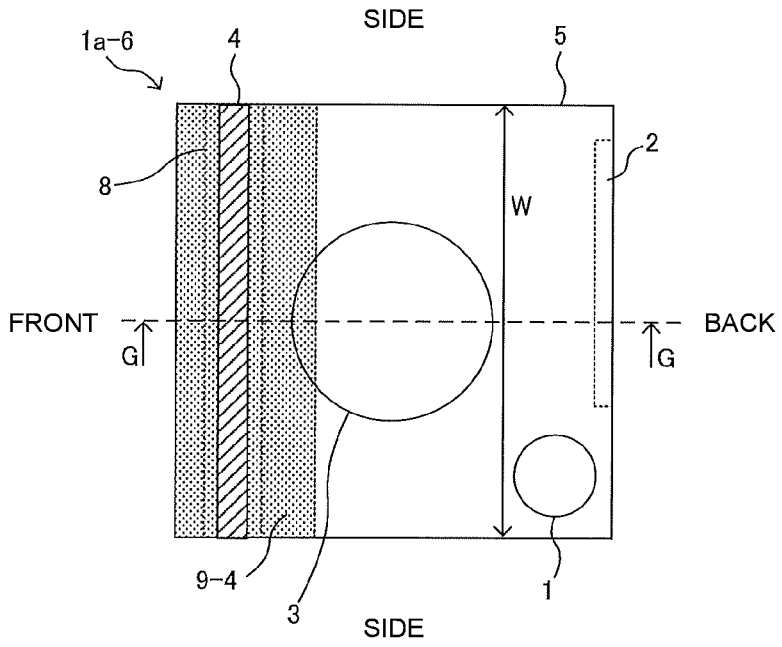
FIG. 27 is a schematic top view of a heat source device of an air-conditioning apparatus according to Embodiment 6 of the present disclosure.
Figure 28:
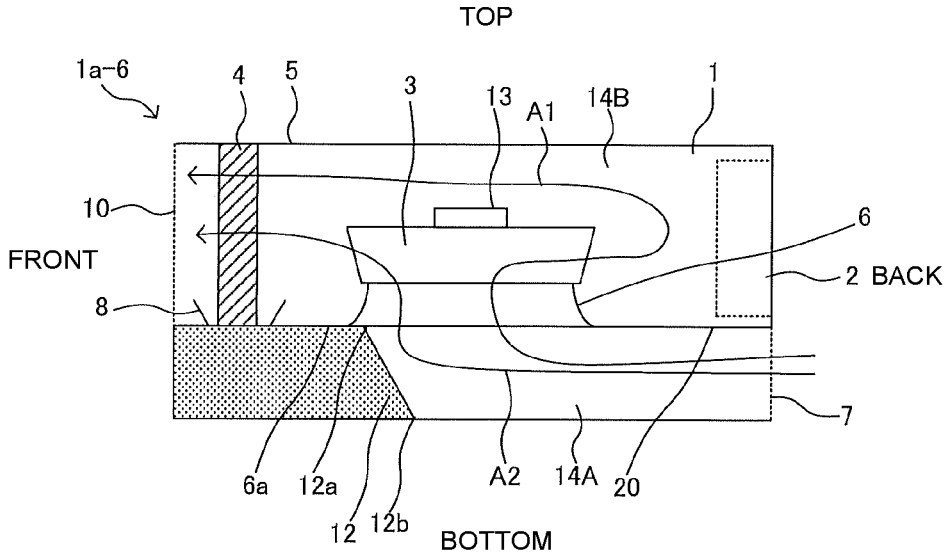
FIG. 28 is an exemplary schematic cross-sectional view taken along G-G in FIG. 27.

FIG. 27 is a schematic top view of a heat source unit 1*a*-6 of an air-conditioning apparatus according to Embodiment 6 of the present disclosure. FIG. 28 is an exemplary schematic cross-sectional view taken along G-G in FIG. 27. The heat source unit 1*a*-6 will be described below with reference to FIGS. 27 and 28. FIG. 27 schematically depicts the interior of the heat source unit 1*a*-6. Further, FIG. 27 depicts an exemplary state in which the right in FIG. 27 corresponds to the back of the heat source unit 1*a*-6, and the left in FIG. 27 corresponds to the front of the heat source unit 1*a*-6.

Although each of Embodiments 1 to 5 described above is directed to an exemplary case in which the inlet air passage 14A is partitioned by an air-passage partition plate, in Embodiment 6, the inlet air passage 14A is partitioned by a sound-absorbing material 12. That is, in Embodiment 6, instead of using an air-passage partition plate, a portion of the lower part of the housing 5 is filled with the sound-absorbing material 12 to thereby define a portion of the inlet air passage 14A. The inlet air passage 14A is identical in configuration to the inlet air passage 14A in each of Embodiments 1 to 5.

The sound-absorbing material 12 will be described below in detail.

The sound-absorbing material 12 is formed in such a manner that upper and lower corners 12*a* and 12*b* of the sound-absorbing material 12 that are close to the inlet air passage 14A are respectively located at the same positions as the end portions 9*a* and 9*b* of the air-passage partition plate 9-2 according to Embodiment 2. The same effect as the effect of Embodiment 2 can be thus obtained. It is to be noted, however, that the upper and lower corners 12*a* and 12*b* may be located at vertically aligned positions.

The configuration according to Embodiment 6 is particularly effective in reducing wind noise generated by the rotation of the impeller 3 or other causes. Consequently, the above-mentioned configuration makes it possible to reduce noise that propagates from the impeller 3 toward the planar face of the housing 5, and noise propagation to the air-conditioned space is thus reduced. The sound-absorbing material 12 may be, example, a porous material or felt.

As described above, the inlet air passage 14A is defined by the wall surface of the housing 5, and the sound-absorbing material 12, which is placed facing the air inlet 7. In addition to the effect obtained by each of Embodiments 1 to 5, this configuration makes it possible to further reduce wind noise generated by the rotation of the impeller 3 or other causes. Embodiment 6 is particularly effective in reducing noise above or equal to 500 Hz. Further, the heat source device 1*a*-6 configured as described above eliminates the need to employ a complicated structure. This configuration ensures improved robustness, and makes it possible to reduce a decrease in the ease of construction and an increase in cost.

The sound-absorbing material 12 corresponds to "air-passage wall".

As with Embodiment 1, the sound-absorbing material 12 can be applied to a load-side device. In this case, the compressor 1 is only required to be removed from the heat source device 1*a*-6. The same effect as mentioned above can be thus obtained for the load-side device as well. As with Embodiment 1, the sound-absorbing material 12 can be applied to an air-sending device. In this case, the compressor 1, the heat exchanger 4, and the drain pan 8 are only required to be removed from the heat source device 1*a*-6. The same effect as mentioned above can be thus obtained for the air-sending device as well.

The air-conditioning apparatus according to Embodiment 6 of the present disclosure includes at least one of the following devices employing the sound-absorbing material 12: the heat source device 1*a*-5, a load-side device, and an air-sending device. As described above, the air-conditioning apparatus according to Embodiment 5 of the present disclosure includes at least one of the heat source device 1*a*-5, a load-side device, and an air-sending device, and both reduced fan input and reduced noise are thus to be achieved. One exemplary configuration of the air-conditioning apparatus according to Embodiment 6 of the present disclosure is the air-conditioning apparatus 100 according to Embodiment 1.

Embodiment 7

Embodiment 7 of the present disclosure will be described below. In Embodiment 7, descriptions overlapping descriptions given with reference to Embodiments 1 to 6 will be omitted, and features identical or corresponding to features of Embodiments 1 to 6 will be designated by the same reference signs.

Figure 29:
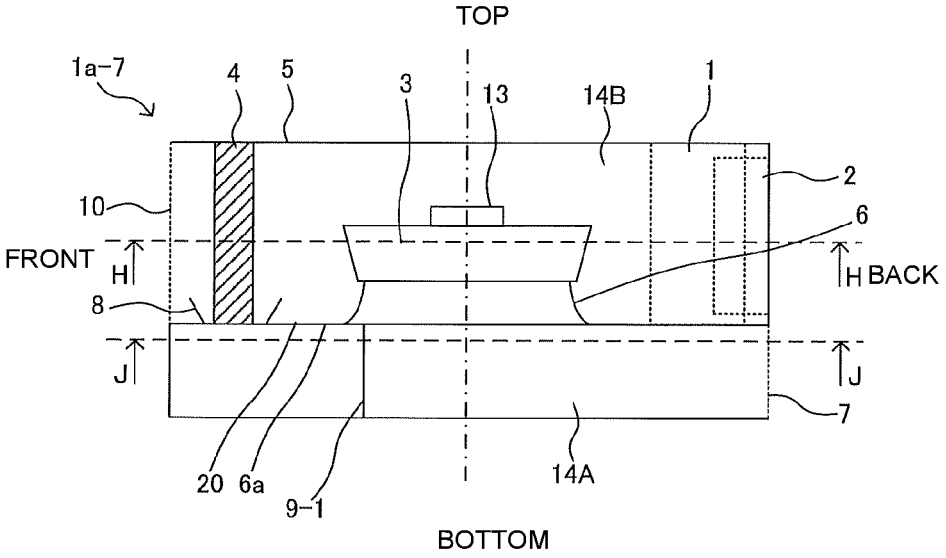
FIG. 29 is a schematic side view of a heat source device of an air-conditioning apparatus according to Embodiment 7 of the present disclosure.
Figure 30:
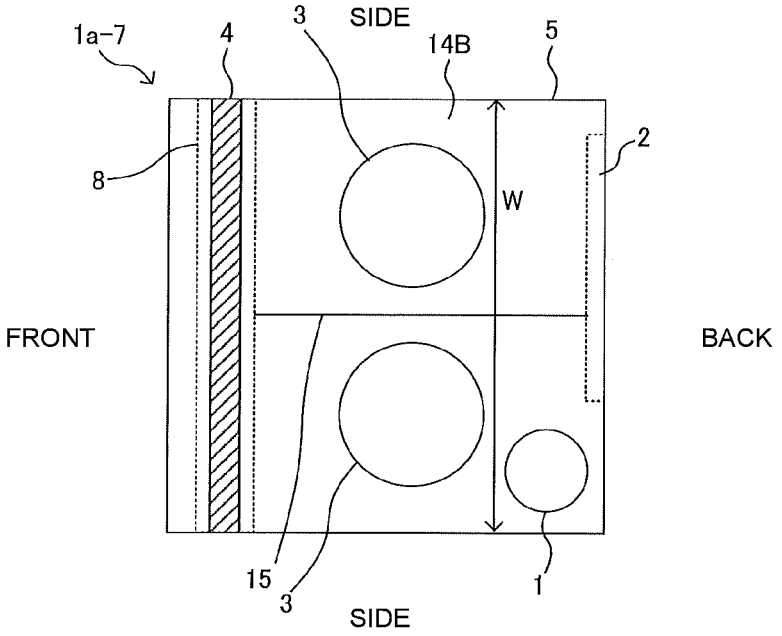
FIG. 30 is an exemplary schematic cross-sectional view taken along H-H in FIG. 29.
Figure 31:
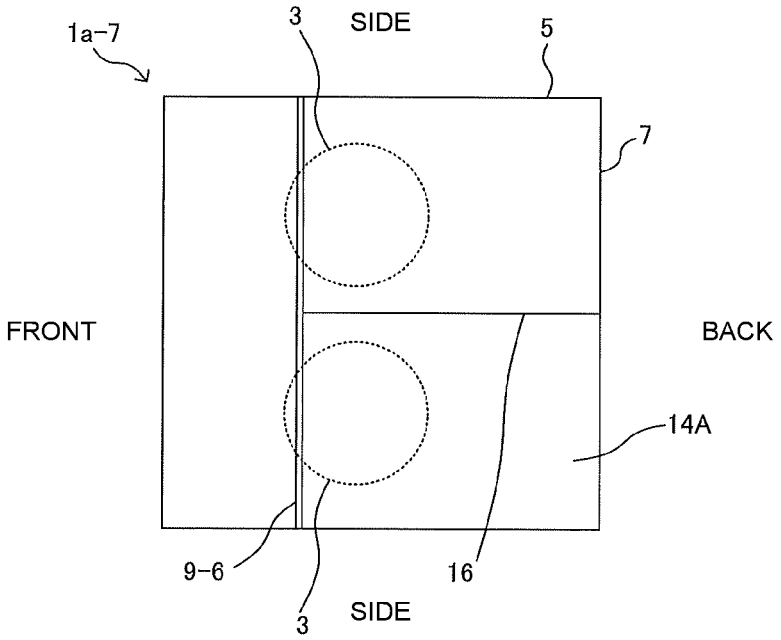
FIG. 31 is an exemplary schematic cross-sectional view taken along J-J in FIG. 29.

FIG. 29 is a schematic side view of a heat source unit 1*a*-7 of an air-conditioning apparatus according to Embodiment 7 of the present disclosure. FIG. 30 is an exemplary schematic cross-sectional view taken along H-H in FIG. 29. FIG. 31 is an exemplary schematic cross-sectional view taken along J-J in FIG. 29. The heat source unit 1*a*-7 will be described below with reference to FIGS. 29 to 31. FIG. 29 schematically depicts the interior of the heat source unit 1*a*-7. Further, FIGS. 30 and 31 depict an exemplary state in which the right in FIGS. 30 and 31 corresponds to the back of the heat source unit 1*a*-7, and the left in FIGS. 30 and 31 corresponds to the front of the heat source unit 1*a*-7.

Although Embodiments 1 to 6 described above are directed to an exemplary case in which a single impeller 3 is provided, in Embodiment 7, plural impellers 3 are provided. As for the bell mouth 6 as well, plural bell mouths 6 equal in number to the impellers 3 installed are installed. In other words, in Embodiment 7, plural impellers 3 are provided to make it possible to achieve an increased rate of airflow. The inlet air passage 14A is identical in configuration to the inlet air passage 14A in each of Embodiments 1 to 5.

An air-passage partition plate 9-6 is detachably disposed in the inlet air passage 14A and partitions the inlet air passage 14A into left and right areas. In other words, the inlet air passage 14A is blocked at a point by the air-passage partition plate 9-6. Consequently, air admitted through the air inlet 7 and flowing in the inlet air passage 14A collides with the air-passage partition plate 9-6. The air thus changes the direction of the air toward the bell mouth 6, and is suctioned into the impeller 3.

As with the air-passage partition plate 9-1, the air-passage partition plate 9-6 is equal in width to the inlet air passage 14A, and is equal in height to the inlet air passage 14A. Further, the air-passage partition plate 9-6 is disposed vertically. Thus, the inlet air passage 14A is defined in a lower portion of the housing 5 by the wall surface of the housing 5 and the air-passage partition plate 9-6, which is placed facing the air inlet 7. The inlet air passage 14A communicates with the air inlet 7 to guide air admitted through the air inlet 7 to the bell mouth 6.

The air-passage partition plate 9-6 corresponds to "air-passage wall".

As illustrated in FIGS. 30 and 31, plural impellers 3 are arranged side by side in the widthwise direction of the housing 5. FIGS. 30 and 31 each depict an exemplary state in which a pair of impellers 3 is installed. Likewise, a pair of bell mouths 6 is installed in correspondence with the pair of impellers 3. As illustrated in FIG. 30, a second partition plate 15 is disposed between the impellers 3 in the outlet air passage 14B and partitions the outlet air passage 14B into portions corresponding to individual impellers 3. As illustrated in FIG. 31, a third partition plate 16 is disposed in a portion of the inlet air passage 14A corresponding to the area between the impellers 3 and partitions the inlet air passage 14A into portions corresponding to individual impellers 3.

When plural impellers 3 are disposed in proximity to each other in the absence of the second partition plate 15 and the third partition plate 16, the flow and pressure fields due to the impellers 3 cause deterioration of aerodynamic characteristics, noise, and fan input. Accordingly, in Embodiment 7, in correspondence with plural impellers 3, the third partition plate 16 is disposed in the inlet air passage 14A, and the second partition plate 15 is disposed in the outlet air passage 14B.

The third partition plate 16 has a length equal to the length from the air-passage partition plate 9-6 to the open end of the air inlet 7, and is disposed in the vicinity of the middle position between plural impellers 3. Further, the third partition plate 16 has a length in the vertical direction, that is, a height that is equal to the height of the inlet air passage 14A.

The second partition plate 15 has a length equal to the length from the drain pan 8 to the control box 2 or to the open end of the air inlet 7, and is disposed in the vicinity of the middle position between plural impellers 3. Further, the second partition plate 15 has a length in the vertical direction, that is, a height that is equal to the height of the outlet air passage 14B.

As a result, providing plural impellers 3 makes it possible to achieve an increased rate of airflow in addition to the effects provided by Embodiments 1 to 6. In other words, providing plural impellers 3 also makes it possible to achieve an increased rate of airflow in addition to the same effects as effects of Embodiments 1 to 6, because the presence of plural impellers 3 helps reduce deterioration of aerodynamic characteristics, noise, and fan input. Further, the heat source device 1*a*-7 configured as described above eliminates the need to employ a complicated structure. This configuration ensures improved robustness, and makes it possible to reduce a decrease in the ease of construction and an increase in cost.

Although FIG. 29 depicts an exemplary case in which the air-passage partition plate 9-6 is disposed vertically, the air-passage partition plate 9-6 may be disposed in an inclined manner as with Embodiment 2. The air-passage partition plate 9-6 may be formed in a curved shape as with Embodiment 3. Further, the air-passage partition plate 9-6 may be provided with fine holes as with Embodiment 5.

Although the above description is directed to an exemplary case in which two impellers 3 are installed, the number of impellers 3 installed is not limited to two. Alternatively, three or more impellers 3 may be installed. In this case as well, the second partition plates 15 and the third partition plates 16 are each disposed between individual impellers 3 to provide the same effect as mentioned above.

As with Embodiment 1, plural impellers 3 can be applied to a load-side device. In this case, the compressor 1 is only required to be removed from the heat source device 1*a*-7. The same effect as mentioned above can be thus obtained for the load-side device as well. As with Embodiment 1, plural impellers 3 can be applied to an air-sending device. In this case, the compressor 1, the heat exchanger 4, and the drain pan 8 are only required to be removed from the heat source device 1*a*-7. The same effect as mentioned above can be thus obtained for the air-sending device as well.

The air-conditioning apparatus according to Embodiment 7 of the present disclosure includes at least one of the following devices in which plural impellers 3 are installed: the heat source device 1*a*-6, a load-side device, and an air-sending device. As described above, the air-conditioning apparatus according to Embodiment 7 of the present disclosure includes at least one of the heat source device 1*a*-6, a load-side device, and an air-sending device, and thus achieves reduced fan input, reduced noise, and increased rate of airflow. One exemplary configuration of the air-conditioning apparatus according to Embodiment 7 of the present disclosure is the air-conditioning apparatus 100 according to Embodiment 1.

Although each of six embodiments of the present disclosure has been separately described above, any one of Embodiments 1 to 7 may be combined with another. In one exemplary configuration, the inlet air passage 14A of which a portion is defined by the sound-absorbing material 12 may be employed in Embodiment 7. In another exemplary configuration, the sound-absorbing material 12 may be provided with fine holes, and a space communicating with each fine hole may be provided inside the sound-absorbing material 12 to thereby form a Helmholtz resonator.

REFERENCE SIGNS LIST

1 compressor 1*a*-1 to 1*a*-7 heat source device 1*b* load-side device 1*c* air-sending device 2 control box 3, 3-1, 3-2 impeller 4, 4-1, 4-2 heat exchanger 5 housing 6 bell mouth 6*a* end portion 7 air inlet 8 drain pan 9-1 to 9-6 air-passage partition plate 9*a*, 9*b* end portion 9*c* central portion 9*d* end portion 10 air outlet 11 fine hole 12 sound-absorbing material 12*a* upper corner 12*b* lower corner 13 fan motor 14A inlet air passage 14B outlet air passage 15 second partition plate 16 third partition plate 17 refrigerant pipe 18 flow switching device 19 pressure reducing device 20 first partition plate 100 air-conditioning apparatus

The invention claimed is:

1. An air-sending device comprising:

a housing including an inlet air passage and an outlet air passage, the inlet air passage communicating with an air inlet, the outlet air passage communicating with an air outlet;

a first partition plate partitioning an interior of the housing into the inlet air passage and the outlet air passage;

a bell mouth disposed around an opening defined in the first partition plate; and an impeller disposed over the first partition plate with the bell mouth interposed between the impeller and the first partition plate, the impeller having a rotation axis that extends in a direction that intersects the first partition plate, the impeller being configured to suction air into the inlet air passage from the air inlet, blow out air in a circumferential direction of the impeller, and blow out air from the air outlet through the outlet air passage, the inlet air passage having a width greater than an outside diameter of a fan blade of the impeller, the inlet air passage guiding air from the air inlet to the opening along the first partition plate, and having an air-passage wall, the air-passage wall being located at a position in the inlet air passage that is past a center of the opening along the first partition plate from the air inlet, at an inlet of the bell mouth, a distance from the rotation axis of the impeller to the air-passage wall being less than a distance from the rotation axis of the impeller to an end portion of the bell mouth that is close to the air inlet to prevent air from entering the impeller from an area located farther from the air inlet than is the air-passage wall, the air-passage wall being equal in width to the inlet air passage.

2. The air-sending device of claim 1, wherein the distance from the rotation axis to the air-passage wall is 0.75 to 0.95 times a radius at the inlet of the bell mouth.

3. The air-sending device of claim 1, wherein the inlet air passage has a height less than a height of the outlet air passage.

4. The air-sending device of claim 1, wherein the air-passage wall is equal in height to the inlet air passage.

5. The air-sending device of claim 1, wherein the air-passage wall is disposed in such a manner that a wall surface of the air-passage wall that faces the inlet air passage is perpendicular to a bottom of the inlet air passage.

6. The air-sending device of claim 1, wherein the air-passage wall is disposed in such a manner that a wall surface of the air-passage wall that faces the inlet air passage is inclined to a bottom of the inlet air passage, and that an end portion of the air-passage wall that is close to the inlet air passage is located closer to the air inlet than is an end portion of the air-passage wall that is close to the bell mouth.

7. The air-sending device of claim 6, wherein the air-passage wall has a length in a horizontal direction in a range of 0.6 to 0.9 times a diameter of a portion of the bell mouth that is close to the air inlet.

8. The air-sending device of claim 1, wherein the air-passage wall has a curved shape that is convex in a downstream direction of air flowing in the inlet air passage, and the air-passage wall is disposed in such a manner that a wall surface of the air-passage wall that faces the inlet air passage is perpendicular to a bottom of the inlet air passage.

9. The air-sending device of claim 1, wherein the air-passage wall has a curved shape that is convex in a downstream direction of air flowing in the inlet air passage, and the air-passage wall is disposed in such a manner that a wall surface of the air-passage wall that faces the inlet air passage is inclined to a bottom of the inlet air passage and that an end portion of the air-passage wall that is close to the bottom of the inlet air passage is located closer to the air inlet than is an end portion of the air-passage wall that is close to the bell mouth.

10. The air-sending device of claim 9, wherein a portion of the air-passage wall located in an interior of the bell mouth has a height that is between a height of the inlet air passage and a distance from a downstream end portion of the bell mouth to the bottom of the inlet air passage, and a portion of the air-passage wall excluding the portion located in the interior of the bell mouth has a height equal to the height of the inlet air passage.

11. The air-sending device of claim 1, Therein the air-passage wall is provided with a plurality of fine holes that communicate with a space behind the air-passage wall.

12. The air-sending device of claim 1, wherein the impeller comprises a plurality of impellers, and the bell mouth comprises a plurality of bell mouths, wherein a second partition plate is disposed between each two of the plurality of impellers, and wherein a third partition plate is disposed in a portion of the inlet air passage corresponding to a position between each two of the plurality of impellers.

13. The air-sending device of claim 1, wherein the air-passage wall comprises an air-passage partition plate that partitions off a portion of the inlet air passage.

14. The air-sending device of claim 1, wherein the air-passage wall comprises a sound-absorbing material disposed to fill a portion of the housing.

15. An air-conditioning apparatus comprising:

a heat source device including an outdoor heat exchanger; and a load-side device including: an indoor heat exchanger, the air-sending device of claim 1 being incorporated in at least one of the heat source device and the load-side device, the outdoor heat exchanger or the indoor heat exchanger being disposed between an area downstream of the impeller and the air outlet.

16. The air-conditioning apparatus of claim 15, wherein the impeller comprises a plurality of impellers, wherein the bell mouth comprises a plurality of bell mouths, the plurality of bell mouths being each disposed to a suction portion of a corresponding one of the plurality of impellers, wherein a second partition plate is disposed between each two of the plurality of impellers, wherein a third partition plate is disposed in a portion of the inlet air passage corresponding to a position between each two of the plurality of impellers, wherein a drain pan is disposed below the at least one heat exchanger, wherein the second partition plate has a length equal to a length from the drain pan to an open end of the air inlet, and has a height equal to a height of the outlet air passage, and wherein the third partition plate has a length equal to a length from the air-passage wall to the open end of the air inlet, and has a height equal to a height of the inlet air passage.

17. An air-sending device, comprising:

a housing including an inlet air passage and an outlet air passage, the inlet air passage communicating with an air inlet, the outlet air passage communicating with an air outlet;

a first partition plate partitioning an interior of the housing into the inlet air passage and the outlet air passage;

a bell mouth disposed around an opening defined in the first partition plate; and an impeller disposed over the first partition plate with the bell mouth interposed between the impeller and the first partition plate, the impeller having a rotation axis that extends in a direction that intersects the first partition plate, the impeller being configured to suction air into the inlet air passage from the air inlet, and blow out air from the air outlet through the outlet air passage, the inlet air passage guiding air from the air inlet to the opening along the first partition plate, and having an air-passage wall, the air-passage wall being located at a position in the inlet air passage that is past a center of the opening along the first partition plate from the air inlet, at an inlet of the bell mouth, a distance from the rotation axis of the impeller to the air-passage wall being less than a distance from the rotation axis of the impeller to an end portion of the bell mouth that is close to the air inlet to prevent air from entering the impeller from an area. located farther from the air inlet than is the air-passage wall, the bell mouth having a D-shaped cross-section with the air-passage wall located on an extension of a straight portion of the D-shape.

18. The air-sending device according to claim 1, wherein the air inlet is located on a first vertical side of the housing, the air outlet is located on a second vertical side of the housing, and the air-passage wall is a vertical wall located between the first vertical side of the housing and the second vertical side of the housing.

19. The air-sending device according to claim 1, wherein an entirety of the first partition plate is arranged below the impeller.

20. The air-sending, device according to claim 1, wherein the air outlet passage is arranged entirely above the first partition plate, and the air inlet passage is arranged entirely below the first partition plate.

21. The air-sending device according to claim 1, wherein a plane of the air-passage wall is parallel to an axial direction of the impeller, and the air-passage wall overlaps the inlet of the bell mouth in a top view.

* * * * *